US008666279B2

(12) United States Patent
Takeyama

(10) Patent No.: US 8,666,279 B2
(45) Date of Patent: Mar. 4, 2014

(54) IMAGE FORMING APPARATUS HAVING PROCESS CARTRIDGE GUIDE PORTIONS

(75) Inventor: Yoshifumi Takeyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 705 days.

(21) Appl. No.: 12/915,536

(22) Filed: Oct. 29, 2010

(65) Prior Publication Data

US 2011/0103831 A1 May 5, 2011

(30) Foreign Application Priority Data

Oct. 30, 2009 (JP) ..... 2009-249751

(51) Int. Cl.
*G03G 21/16* (2006.01)

(52) U.S. Cl.
USPC ..... 399/111; 399/124

(58) Field of Classification Search
USPC ..... 399/111, 124
See application file for complete search history.

(56) References Cited

U.S. PATENT DOCUMENTS

| | | | |
|---|---|---|---|
| 6,968,142 | B2 | 11/2005 | Aritmitsu et al. |
| 7,046,942 | B2 | 5/2006 | Aritmitsu et al. |
| 7,242,889 | B2 | 7/2007 | Ahn et al. |
| 7,424,243 | B2 | 9/2008 | Kweon |
| 2003/0156856 | A1 | 8/2003 | Aritmitsu et al. |
| 2005/0185984 | A1 | 8/2005 | Aritmitsu et al. |
| 2005/0276629 | A1 | 12/2005 | Ahn et al. |
| 2006/0257165 | A1 | 11/2006 | Kweon |
| 2010/0054797 | A1 | 3/2010 | Takeyama et al. |

FOREIGN PATENT DOCUMENTS

| | | | |
|---|---|---|---|
| JP | 55-133076 | A | 10/1980 |
| JP | 58-043742 | B | 9/1983 |
| JP | 10-69207 | A | 3/1998 |
| JP | 11-143304 | A | 5/1999 |
| JP | 2000-172142 | A | 6/2000 |
| JP | 2000-194247 | A | 7/2000 |
| JP | 2003-167434 | A | 6/2003 |
| JP | 2003-241620 | A | 8/2003 |
| JP | 2004-279689 | A | 10/2004 |
| JP | 2005-134483 | A | 5/2005 |
| JP | 2005-283881 | A | 10/2005 |

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes a belt member for transferring a developed image formed on an image bearing member onto a recording material, and an opening provided to permit a cartridge including the image bearing member to enter inside of the image forming apparatus. In addition, a first guide portion guides the cartridge through the opening from a position where a bottom end portion of the image bearing member is below, with respect to a vertical direction, a transfer position where the image bearing member and the belt member contact each other when the cartridge is mounted, a second guide portion guides the cartridge from a position where the bottom end portion is below, with respect to the vertical direction, the transfer position to a position where the bottom end portion is above the transfer position, and a third guide portion guides the cartridge from the position where the bottom end portion is above, with respect to the vertical direction, the transfer position to the transfer position.

5 Claims, 15 Drawing Sheets

(a)

(b)

(a)

(b)

(a)

(b)

(a)

(b)

IMAGE FORMING APPARATUS HAVING PROCESS CARTRIDGE GUIDE PORTIONS

FIELD OF THE INVENTION AND RELATED ART

The present invention relates to an image forming apparatus to which a process cartridge including an image bearing member and a frame supporting the image bearing member is detachably mountable.

Here, the image forming apparatus forms an image on a recording material using an image forming process. Examples of the image forming apparatus include a copying machine, a printer (LED printer, laser beam printer or the like), a facsimile machine and a word processor. The recording material receives an image from the image forming apparatus and is paper, OHP sheet and so on.

In an image forming apparatus for forming an image on a recording material using a developer, a process cartridge has been put into practice, which includes as a unit (cartridge) an image bearing member, and process means actable thereon. By exchanging the process cartridge, the supply of the developer and the exchange of parts having reached the service lives are exchanged in effect, thus making the maintenance of the image forming apparatus easier. The process cartridge here contains an image bearing member and process means including at least one of charging means, developing means and cleaning means which are formed into a unit detachably mountable to the main assembly of the image forming apparatus.

On the other hand, in a known system of a color image forming apparatus capable of forming a color image on a recording material using developers of different colors, a plurality of developing means are carried rotatably around the image bearing member. Japanese Laid-open Patent Application 2000-172142 discloses a color image forming apparatus in which developing cartridges each including developing means as the process means and a developer accommodating portion, and a drum cartridge including the image bearing member and the cleaning means are detachably mountable to the main assembly of the image forming apparatus. The developing cartridges are detachably mountable to a rotatable supporting member which is rotatably mounted to the main assembly of the apparatus, and the developing zones of the developing cartridges are brought to the position opposing to the image bearing member sequentially by rotation of the rotation supporting member. Such a color image forming apparatus is advantages in downsizing of the main assembly of the apparatus because one image bearing member is enough for color image formation.

Japanese Patent Application Publication Sho 58-43742, Japanese Laid-open Patent Application 2003-167434, U.S. Pat. No. 7,242,889, and U.S. Pat. No. 7,424,243 for example, disclose various structures for mounting and demounting a cartridge including the developing cartridge and the drum cartridge to the image forming apparatus. More particularly, Japanese Patent Application Publication Sho 58-43742 discloses a structure in which a unit including the photosensitive member is mounted to a predetermined position along an arcuate guide. Japanese Laid-open Patent Application 2003-167434 discloses a structure in which the developing cartridge and the process cartridge are mounted to and held in the main assembly of the image forming apparatus. U.S. Pat. No. 7,242,889 and U.S. Pat. No. 7,424,243 discloses a guide structure and a grip configuration used in mounting a process cartridge to an image formation position of the main assembly of the image forming apparatus from the bottom of the apparatus.

SUMMARY OF THE INVENTION

Recently, the demand for downsizing of the image forming apparatus increases because of the increase of the small office use and individual user. In addition, the demand for color image output also increases, and a small size color image forming apparatus is desired.

However, a color image forming apparatus is required to have four developing means, an image bearing member, exposure means, a belt member for transferring the developed image formed on the image bearing member onto the recording material and so on. In order to downsize such a color image forming apparatus, said parts are to be arranged to meet the demand for the downsizing. The process cartridge including the image bearing member is to be detachably mountable to the main assembly of the image forming apparatus. To accomplish the, the image forming apparatus has to be provided with an opening for mounting and demounting of the process cartridge and a mounting-and-demounting path. Therefore, the downsizing has to be accomplished under the condition that four developing means, an image bearing member, exposure means, a belt member, the opening and the mounting-and-demounting path.

The belt member contacts the image bearing member during image formation, but the contact therebetween during the mounting and demounting of the process cartridge has to be avoided since otherwise the surface of said image bearing member may be damaged with the result of image defect. The structure should be such that the contact during the mounting and demounting can be avoided. However, this requirement for non-contact is against the downsizing.

Accordingly, it is an object of the present invention to provide a downsized image forming apparatus in which a process cartridge is guided such that the image bearing member smoothly contacts the belt member.

According to an aspect of the present invention, there is provided an image forming apparatus to which a cartridge including an image bearing member and a frame supporting said image bearing member, said image forming apparatus comprising a belt member for transferring a developed image formed on said image bearing member onto a recording material; an opening provided to permit said cartridge to enter an inside of a main assembly of said image forming apparatus; a first guide portion for guiding said cartridge through said opening from a position where a bottom end portion of said image bearing member is below a transfer position where said image bearing member and said belt member contact with each other when said cartridge is mounted; a second guide portion provided downstream of said first guide portion with respect to a mounting direction in which said cartridge is mounted to said main assembly of the apparatus, said second guide portion guiding said cartridge from a position where the bottom end portion is below the transfer position to a position where the bottom end portion is above the transfer position; and a third guide portion provided downstream of said second guide portion with respect to the mounting direction, said third guide portion guiding said cartridge from the position where the bottom end portion is above the transfer position to the transfer position.

According to another aspect of the present invention, there is provided an image forming apparatus to which a cartridge including an image bearing member and a frame supporting said image bearing member, said image forming apparatus includes a belt member for transferring a developed image formed on said image bearing member onto a recording material; an opening provided to permit said cartridge to enter an inside of a main assembly of said image forming apparatus; a first guide portion for guiding said cartridge through said opening from a position where at least a part of said image bearing member is in a back side opposite a front side where said image bearing member and said belt member contact with each other beyond an extension plane (L2) of a surface of said belt member including a transfer position where said image bearing member and said belt member contact with each other when said cartridge is mounted; a second guide portion provided downstream of said first guide portion with respect to a mounting direction in which said cartridge is mounted to said main assembly of the apparatus, said second guide portion guiding said cartridge from a position where at least a part of said image bearing member is in the back side of the extension plane to a position where said image bearing member is away from the extension plane in the front side; and a third guide portion provided downstream of said second guide portion with respect to the mounting direction of said cartridge, said third guide portion guiding said cartridge from a position where said image bearing member is away from the extension plane in the front side of the extension plane.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. The measurements, materials, and shapes of any of the structural components of the image forming apparatus and drum cartridges therefor, and their positional relationship, in the preferred embodiments, are not intended to limit the present invention in scope. That is, they should be modified as necessary in accordance with the structure of the image forming apparatus to which the present invention is applied, and the various conditions under which the apparatuses are operated. In other words, they are not intended to limit the present invention in scope unless specifically noted.

Embodiment 1

Image Forming Apparatus

Figure 1A:
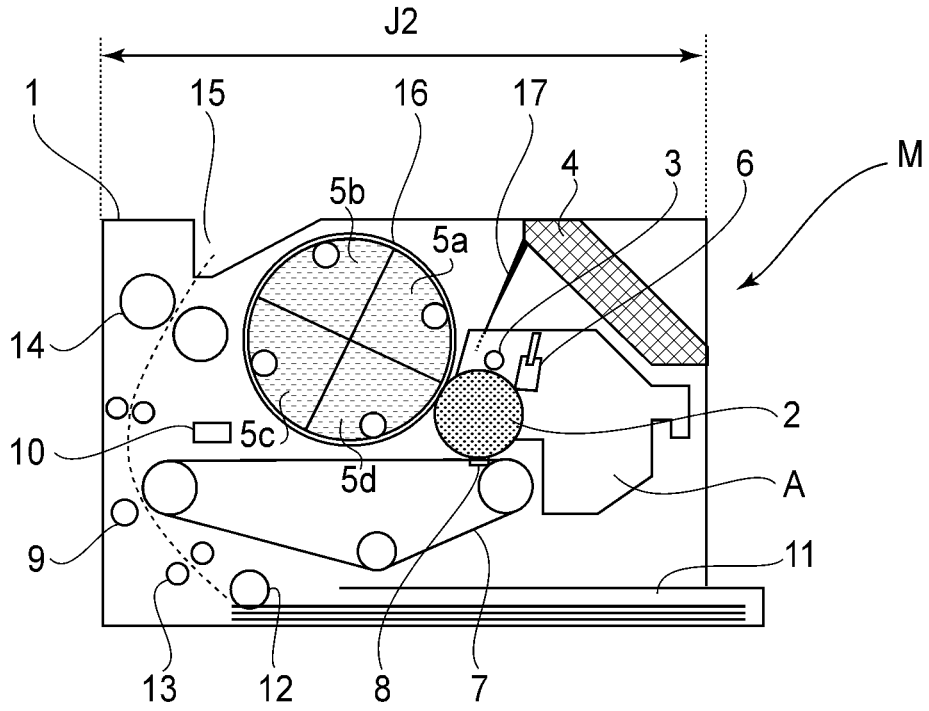
FIGS. 1A, 1B, and 1C are schematic sectional views of an example of image forming apparatus in the first preferred embodiment of the present invention, and show three distinctive stages through which a drum cartridge is mounted into, or dismounted from, the main assembly of the image forming apparatus.
Figure 1B:
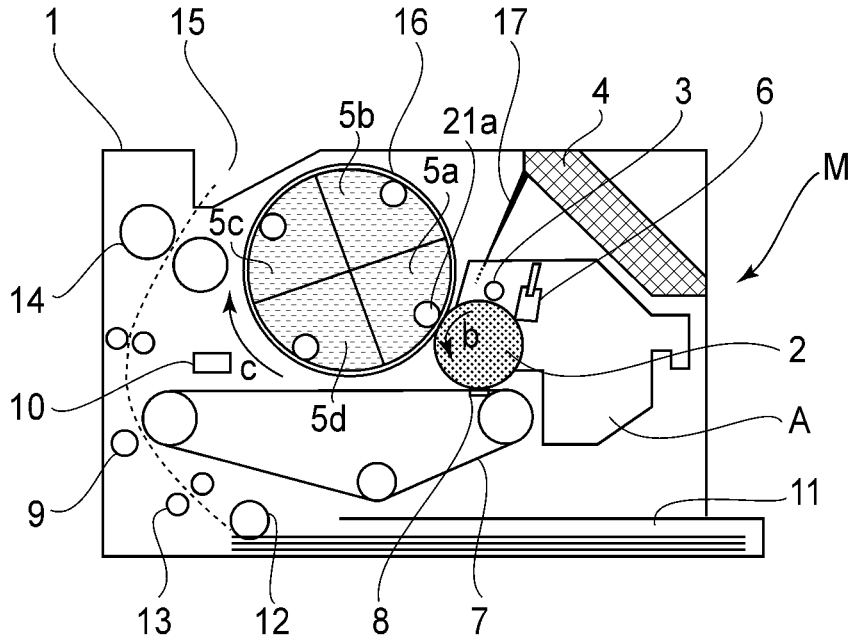
Figure 1C:
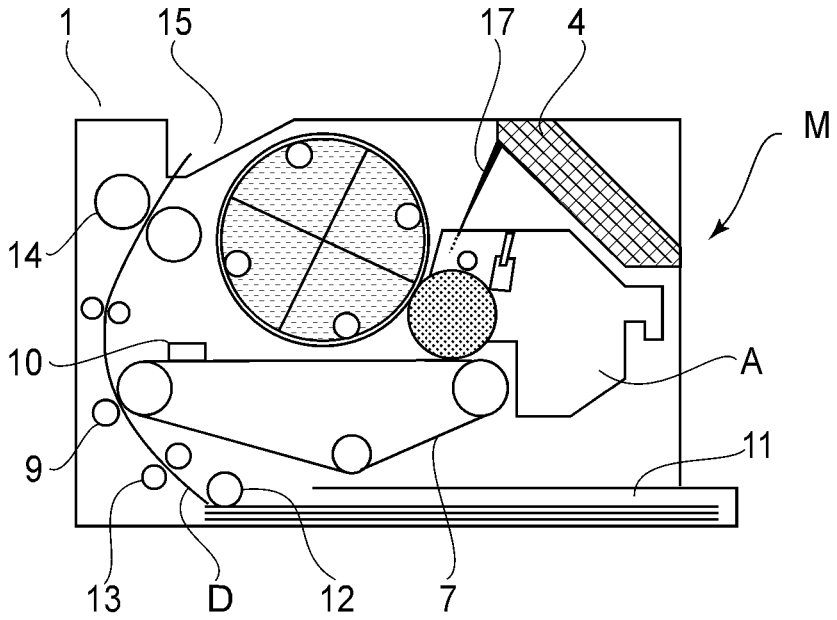

The electrophotographic image forming apparatus M (which hereafter may be referred to simply as image forming apparatus M) is an example of a full-color laser beam printer based on four primary colors. FIGS. 1A, 1B, and 1C are schematic sectional views of the image forming apparatus, and show the general structure of the apparatus.

Referring to FIG. 1A, the main assembly 1 of the image forming apparatus M has: an image bearing member 2, a charge roller 3, four developing apparatuses 5*a*, 5*b*, 5*c*, and 5*d*, and a cleaning blade 6, which are in the adjacencies of the peripheral surface of the image bearing member 2. The charge roller 3 is a charging means for uniformly charging the image bearing member 2. The exposing means 4 forms a latent image on the peripheral surface of the image bearing member 2, by projecting a beam 17 of laser light in a manner to scan the peripheral surface of the image bearing member 2 with the beam 17. Each of the four developing apparatuses 5 has a developing means for developing the latent image on the image bearing member 2 into a visible image with the use of the developer therein. The four developing apparatuses 5 in this embodiment are developing apparatuses 5*a*, 5*b*, 5*c*, and 5*d*, which are different in the color of the developer they use. The cleaning blade 6 is a cleaning means for removing the residual developer on the image bearing member 2. In order to minimize the image forming apparatus M in size, the main assembly and exposing means 4 of the image forming apparatus are structured so that the exposing apparatus 4 is positioned at an angle relative to the horizontal direction when the apparatus M is on a horizontal surface. The image bearing member 2, charge roller 3, and cleaning blade 6 are integrally placed in a cartridge, making up a drum cartridge A (process cartridge) which is removably mountable in the main assembly 1.

Figure 2:
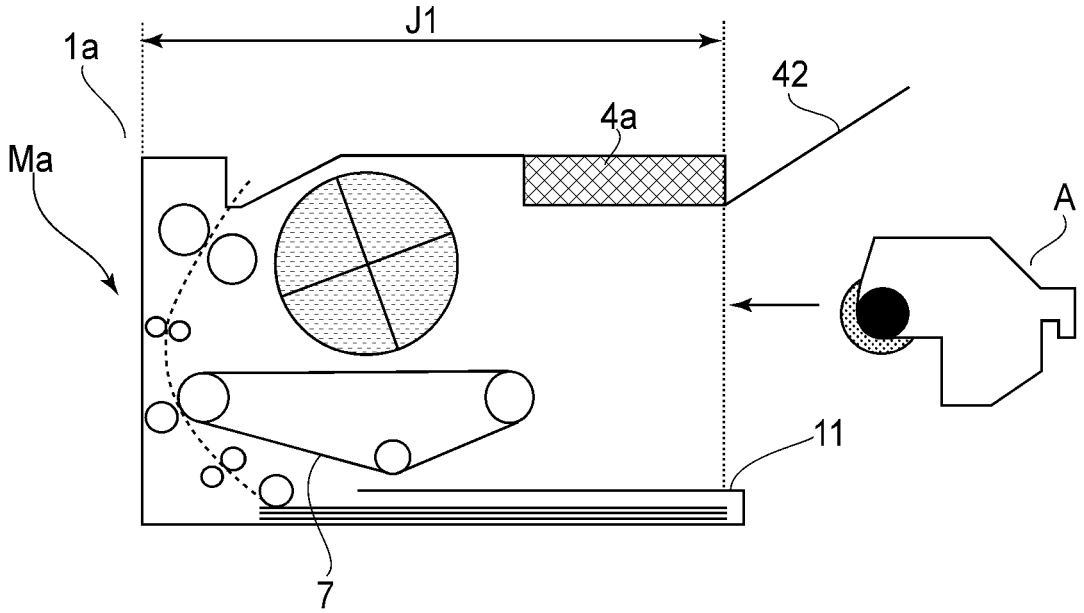
FIG. 2 is a schematic sectional view of one of the conventional image forming apparatuses comparable to the one in the first embodiment, and shows how a drum cartridge is mounted into, or dismounted from, the main assembly of the image forming apparatus.

FIG. 2 is a schematic sectional view of a comparative image forming apparatus Ma, which is an example of an image forming apparatus, the exposing means of which is horizontal when the apparatus is on a horizontal surface. In the case of the comparative image forming apparatus Ma, the drum cartridge A has to be inserted straight into the main assembly 1*a* from the right side of the FIG. 2, and therefore, the exposing apparatus 4*a* has to be above the drum passage, that is, the passage through which the drum cartridge A is mounted into, or dismounted from, the main assembly 1*a*. In comparison, in the case of the image forming apparatus M in this embodiment, its exposing means 4 is tilted relative to the main assembly 1*a* of the apparatus M as shown in FIG. 1A. Thus, the overall length J2 of the main assembly 1 in this embodiment is less than the overall length of the apparatus main assembly 1*a* of the image forming apparatus Ma. That is, the image forming apparatus M in this embodiment is smaller in size than comparable image forming apparatuses in accordance with the prior arts; the present invention can significantly reduce an image forming apparatus in size compared to the image forming apparatuses in accordance with the prior arts.

The yellow, magenta, cyan, and black developing apparatuses 5*a*, 5*b*, 5*c*, and 5*d*, respectively, are held by a developing apparatus supporting rotatable member 16 (which hereafter will be referred to simply as rotary 16), which is rotatably supported by the main assembly 1. The yellow, magenta, cyan, and black developing apparatuses 5*a*, 5*b*, 5*c*, and 5*d* may be immovably attached to the rotary 16, or may be in the form of a cartridge (development cartridge) which is removably mountable in the rotary 16. The yellow, magenta, cyan, and black developing apparatuses 5*a*, 5*b*, 5*c*, and 5*d* which are going to be described next are described as developing apparatuses in the form of a development cartridge which is removably mountable in the rotary 16.

While an electrostatic latent image is formed on the peripheral surface of the image bearing member 2, the rotary 16 in which the yellow, magenta, cyan, and black developing apparatuses 5*a*, 5*b*, 5*c*, and 5*d*, respectively, are held is rotated in the direction indicated by an arrow mark c in FIG. 1B, by a driving means (unshown), so that the yellow developing apparatus 5*a*, for example, is positioned in the development point, at which the yellow developing apparatus 5*a* directly faces the image bearing member 2, as shown in FIG. 1B.

Meanwhile, the image bearing member 2 is rotated in the direction indicated by an arrow mark b in FIG. 1B in synchronism with the circular movement of the intermediary transfer belt 7. As the image bearing member 2 is rotated, the peripheral surface of the image bearing member 2 is uniformly charged by the charge roller 3. Then, the uniformly charged portion of the peripheral surface of the image bearing member 2 is exposed by the exposing means 4; it is scanned by the beam of laser light projected by the exposing means while being modulated with electric signals which reflect the information regarding the yellow component of the image to be formed. Thus, an electrostatic latent image which corresponds to the yellow component of the image to be formed is formed on the peripheral surface of the image bearing member 2.

Then, image bearing member 2 and the development roller 21*a* of the developing apparatus 5*a* are made different in potential level so that the yellow developer adheres to the latent image on the peripheral surface of the image bearing member 2. Thus, the yellow developer adheres to the peripheral surface of the image bearing member 2 in the pattern of the latent image; it develops the latent image on the peripheral surface of the image bearing member 2 into a visible image (yellow developer image: yellow toner image).

After the formation of the yellow developer image on the peripheral surface of the image bearing member 2, a preset voltage which is opposite in polarity to the developer is applied to the first transferring means 8, which is on the inward side of the loop of intermediary transfer belt 7. Thus, the yellow developer image on the image bearing member 2 transfers (first transfer) onto the intermediary transfer belt 7.

As the above described process for transferring (first transfer) the yellow developer image ends, the rotary 16 is driven by the rotary driving means (unshown) so that the rotary 16 rotates in the direction indicated by the arrow mark c to sequentially place the magenta developing apparatus 5*b*, cyan developing apparatus 5*c*, and black developing apparatus 5*d*, in the development point, where each developing apparatus directly opposes the image bearing member, to sequentially form magenta, cyan, and black toner image, on the peripheral surface of the image bearing member 2, through the same processes as the processes through which the yellow image is formed on the image bearing member 2, and are transferred (first transfer) onto the intermediary transfer belt 7 in such a manner that they are placed in layers on the yellow image on the intermediary transfer belt 7.

While the four developer images, different in color, are layered on the intermediary transfer belt 7, the second transfer roller 9 is kept separated from the intermediary transfer belt 7, and so is the cleaning unit 10 for cleaning the intermediary transfer belt 7.

The sheets D of recording medium on which an image is to be formed are stored in layers in the sheet feeder cassette 11 which is in the bottom portion of the apparatus main assembly 1. Each sheet D of recording medium is fed into the main assembly 1, while being separated from the rest in the cassette 11. Then, the sheet D is conveyed to the pair of registration rollers 13, which release the sheet D in such timing that the sheet D is delivered to the interface between the intermediary transfer belt 7 and second transfer roller 9 with a preset timing. In the interface between the second transfer roller 9 and intermediary transfer belt 7, the second transfer roller 9 is kept pressed upon the intermediary transfer belt 7.

While the sheet D is conveyed through the interface between the second transfer roller 9 and intermediary transfer belt 7, a preset voltage which is opposite in polarity to the developer is applied to the second transfer roller 9. Thus, as the sheet D is conveyed through the interface, the layered four developer images, different in color, on the intermediary transfer belt 7, are transferred all at once (second transfer) onto the surface of the sheet D which is being conveyed through the interface.

After the transfer of the developer images onto the sheet D, the sheet D is conveyed to the fixing device 14, in which the sheet D is subjected to heat and pressure so that the developer images become fixed to the sheet D. As a result, a fixed multicolor image is formed on the sheet D. Thereafter, the sheet D is discharged from the fixing device 14 into the delivery tray, which is a part of the top wall of the apparatus main assembly 1.

Incidentally, the image forming apparatus M is structured to use a belt as the intermediary transferring means for transferring the developer on the image bearing member 2 onto the sheet D. However, an electrostatic conveyer belt may be employed as the means for conveying the sheet D of recording medium.

<Developing Apparatus>

The yellow, magenta, cyan, and black developing apparatuses 5*a*, 5*b*, 5*c*, and 5*d*, respectively, which are in FIG. 1A, are the same in structure. Thus, the structure of the developing apparatus 5 in this embodiment is described with reference to the yellow developing apparatus 5*a*, which is in FIG. 3.

Figure 3:
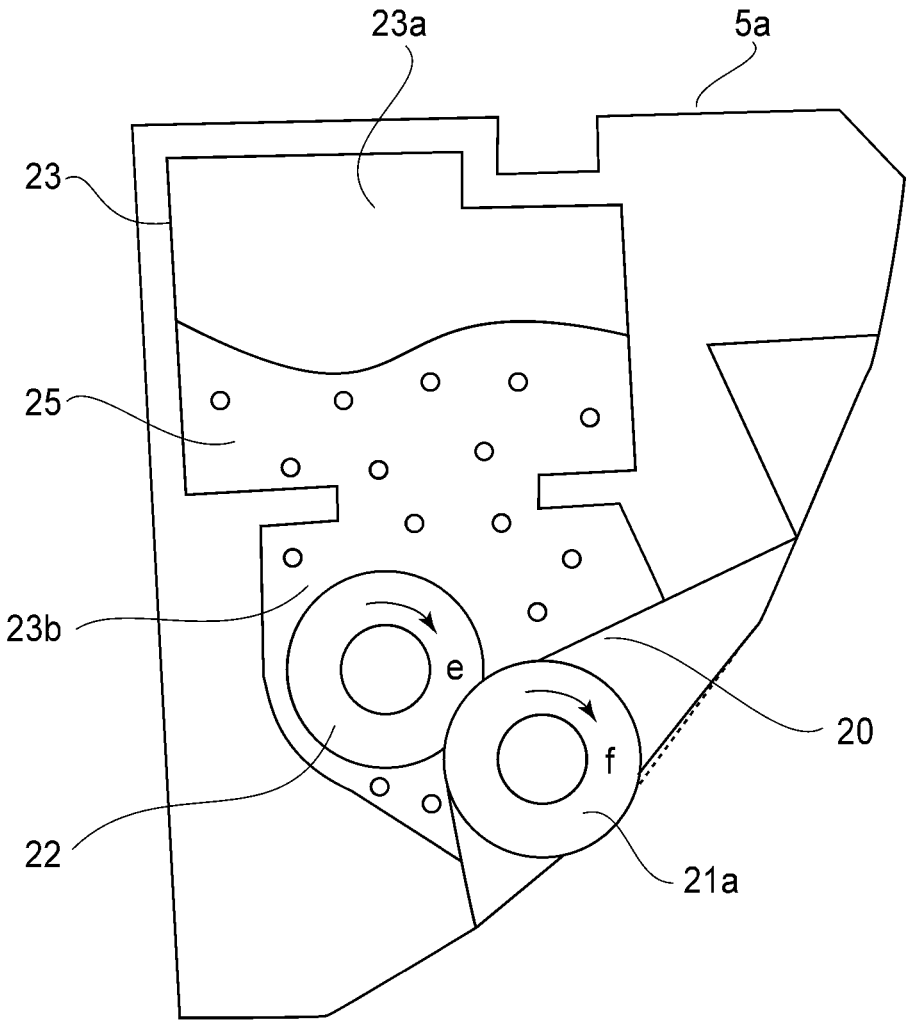
FIG. 3 is a schematic sectional view of an example of developing apparatus removably mountable in the aforementioned image forming apparatuses, and shows the essential portions of the development cartridge.

FIG. 3 is a schematic sectional view of the yellow developing apparatus 5*a* in this embodiment, and shows the general structure of the apparatus 5*a*. The shell 23 of the yellow developing apparatus 5*a* has: a developer storage chamber 23*a*; and a development chamber 23*b* in which the development roller 21*a* and developer supplying roller 22 are located. The developer 25 in the development chamber 23*b* is supplied to the developer supply roller 22. As the developer supply roller 22 is rotated in the direction indicated by an arrow mark e, the development roller 21*a* is supplied with the developer 25 by the developer supply roller 22. The development roller 21*a* is an elastic rubber roller, and is rotated in the direction indicated by an arrow mark f in FIG. 3. As the development roller 21*a* is rotated in the direction of the arrow mark f, the body of developer 25 on the peripheral surface of the development roller 21*a* is formed by a development blade 20 into a developer layer, which is uniform in thickness, and from which the developer is adhered to the image bearing member 2. The developer 25 remaining on the development roller 21*a* after the development of the latent image on the image bearing member 2 is removed by the developer supply roller 22, and then, the portion of the peripheral surface of the development roller 21*a*, from which the residual developer has just been removed, is supplied again with the developer by the development supply roller 22.

In order to ensure that the development roller 21*a* remains in contact with the image bearing member 2 at the development point, the rotary 16 which is holding the yellow developing apparatus 5*a*, is kept pressed in entirety toward the image bearing member 2 by keeping the lengthwise end portions of the rotational axle of the rotary 1, at which the rotary 1 is supported by the image forming apparatus M. With this structural arrangement, the development roller 21*a* of the yellow developing apparatus 5*a* is kept pressed upon the image bearing member 2 so that a preset amount of contact pressure is maintained between the development roller 21*a* and image bearing member 2.

The developing apparatus 5*a* described above has the development roller 21*a*, developer supply roller 22, development blade 20, and development chamber 23*b*. However, all that is required of the developing apparatus is to have a developing means. In other words, the present invention is also applicable to developing apparatuses which have various processing means other than the developing means, and components different from those of the developing apparatus 21*a*, and are different in structure from the developing apparatus 21*a*.

<Drum Cartridge>

Figure 4:
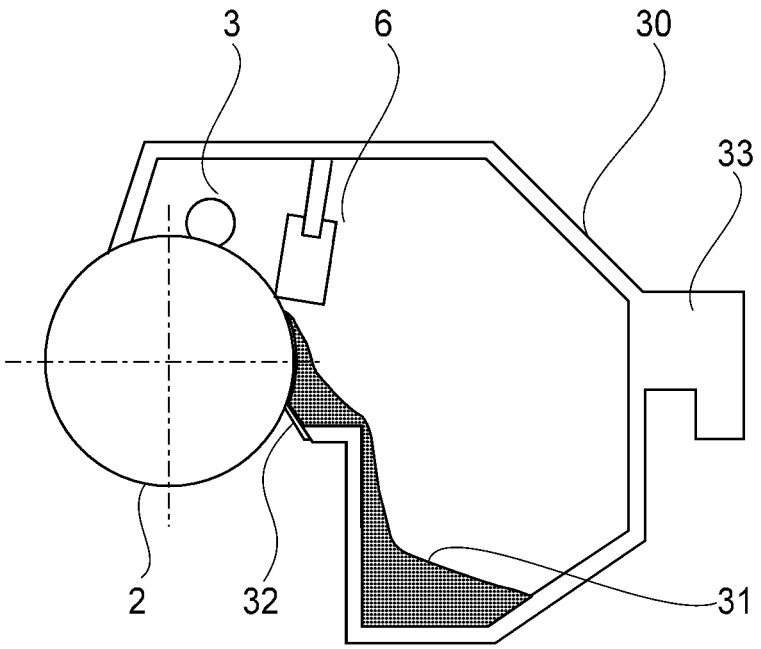
FIG. 4(*a*) is a schematic sectional view of an example of the drum cartridge in the first embodiment, and FIG. 4(*b*) is a schematic sectional view of the drum cartridge in the first embodiment.
Figure 4:
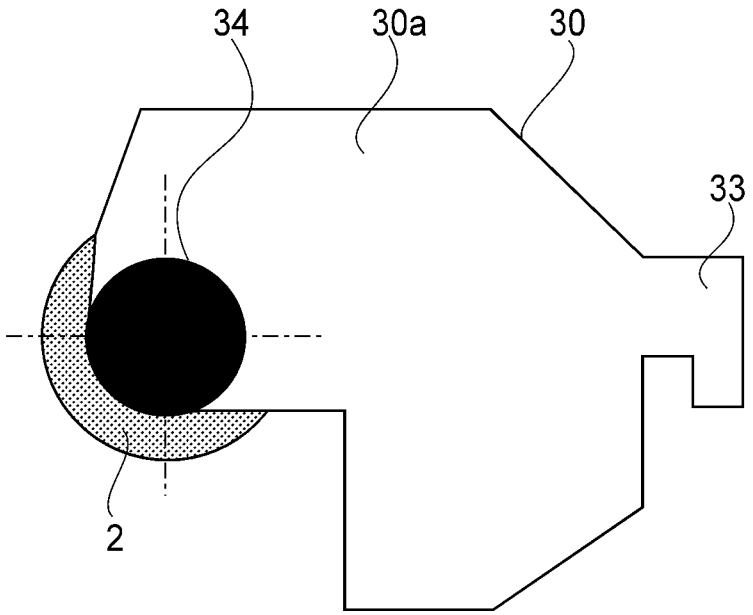

Next, referring to FIGS. 4(*a*) and 4(*b*), the drum cartridge A is described. FIG. 4(*a*) is a schematic sectional view of the drum cartridge A, and FIG. 4(*b*) is a side view of the drum cartridge A.

The drum cartridge A in this embodiment comprises the image bearing member 2, charging means 3, cleaning blade 6, and drum cartridge frame 30. The image bearing member 2, charging means 3, and cleaning blade 6 are integrally held in the cartridge frame 30 in the preset positional relationship. The charging means 3 uniformly charges the peripheral surface of the image bearing member 2 to the preset polarity and potential level, for the formation of an electrostatic latent image. The cleaning blade 6 removes the transfer residual developer on the image bearing member 2, and stores the removed transfer residual developer in the waste developer storage chamber of the drum cartridge frame 30. The drum cartridge frame 30 is provided with a flexible sheet 32 which is in contact with the peripheral surface of the image bearing member 2 to prevent the transfer residual developer 31 in the waste developer storage chamber from leaking. Further, the drum cartridge A has a pair of support projections 34 by which the drum cartridge A is guided. The support projections 34 are integral with the cartridge frame 30. Further, the drum cartridge A has a handhold 33 which is to be grasped by a user when the user carries the drum cartridge A, or mounts the cartridge A into the image forming apparatus M or dismounts the cartridge A from the image forming apparatus M.

Next, referring to FIG. 4(*b*), the drum cartridge A is provided with the pair of support projections 34, as described above, which project from the lengthwise end surfaces 30*a* of the drum cartridge A in the direction parallel to the lengthwise direction of the cartridge A. The projections 34 may be formed as integral parts of the surface 30*a*, or a pair of lateral plates (unshown) with which the end portions of the drum cartridge frame 34 in terms of the direction parallel to the rotational axis of the image bearing member 2, are provided one for one. The support projections 34 project in the direction parallel to the axial line of the image bearing member 2. That is, the opposite surface of the drum cartridge A from the surface 30*a* shown in FIG. 4(*b*) has also a support projection 34. Each projection 34 fits in the cartridge guiding groove in the image forming apparatus M when the drum cartridge A is mounted into, or dismounted from, the apparatus M. All that is required of the drum cartridge A is that it is provided with a pair of support projections (34) which project from the lengthwise end surfaces of the cartridge A, one for one. The position of the support projection 34 relative to the corresponding end surface 30*a* of the cartridge frame 30 is optional. Thus, the pair of support projections 34 of the cartridge frame 30 and the pair of cartridge guiding grooves of the apparatus main assembly 1 may be varied in shape and position so that the drum cartridge A can be mounted into, or dismounted from, the main assembly 1 while being controlled in position and attitude. Next, the operation for mounting the drum cartridge A into the main assembly 1, or dismounting the drum cartridge A from the main assembly 1, is described, assuming that the pair of support projections 34 are coaxial with the image bearing member 2, and symmetrically positioned relative to the cartridge frame 30.

<Mounting and Dismounting of Drum Cartridge A>

Figure 5:
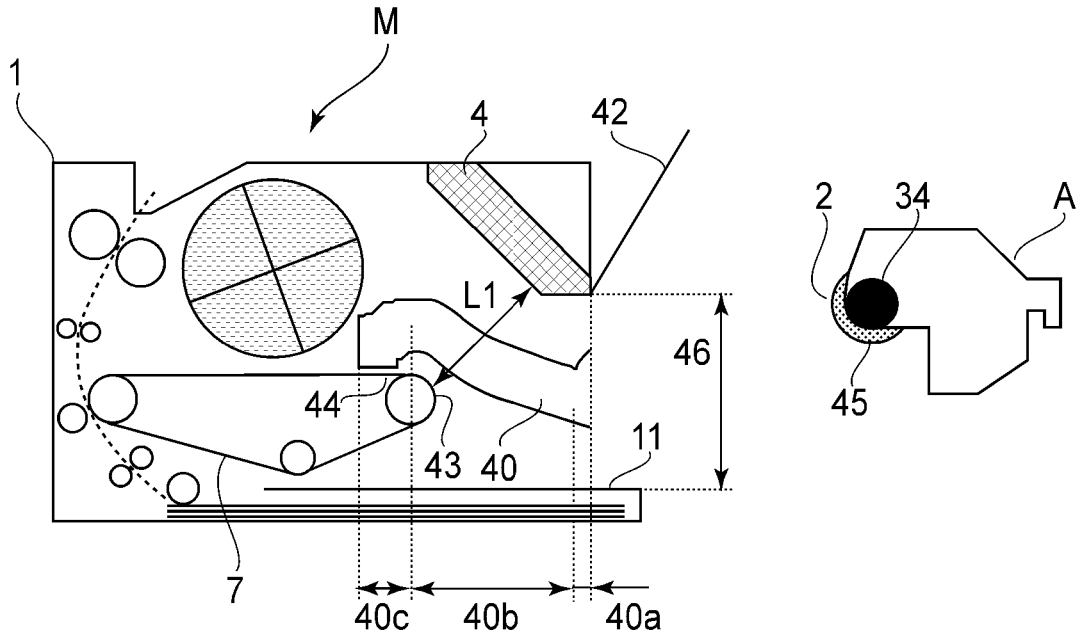
FIGS. 5(*a*) and 5(*b*) are schematic sectional views of the image forming apparatus in the first embodiment, and show how a drum cartridge is mounted into, or dismounted from the main assembly of the apparatus.
Figure 5:
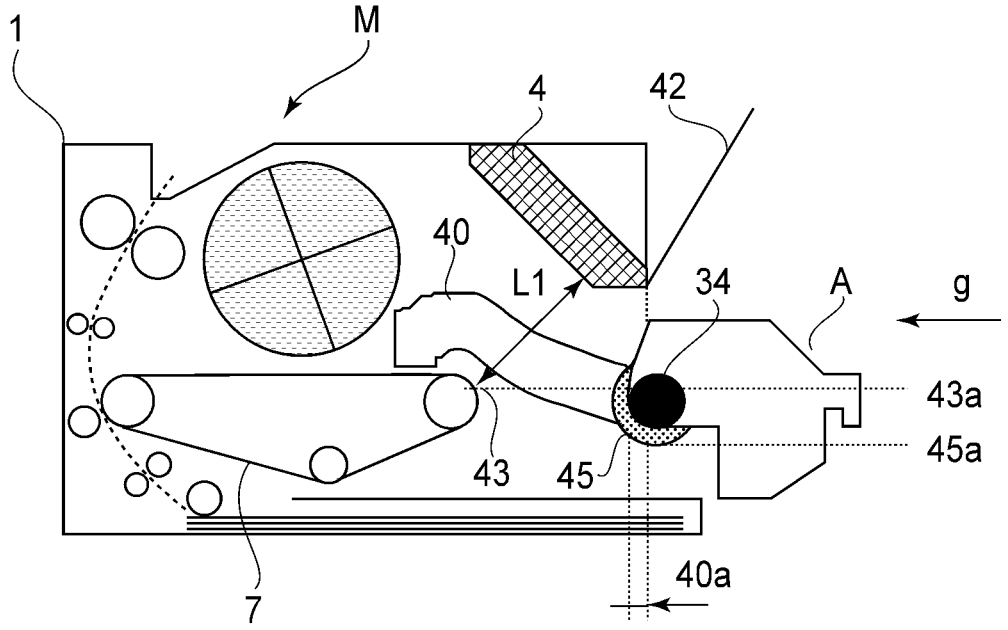
Figure 6:
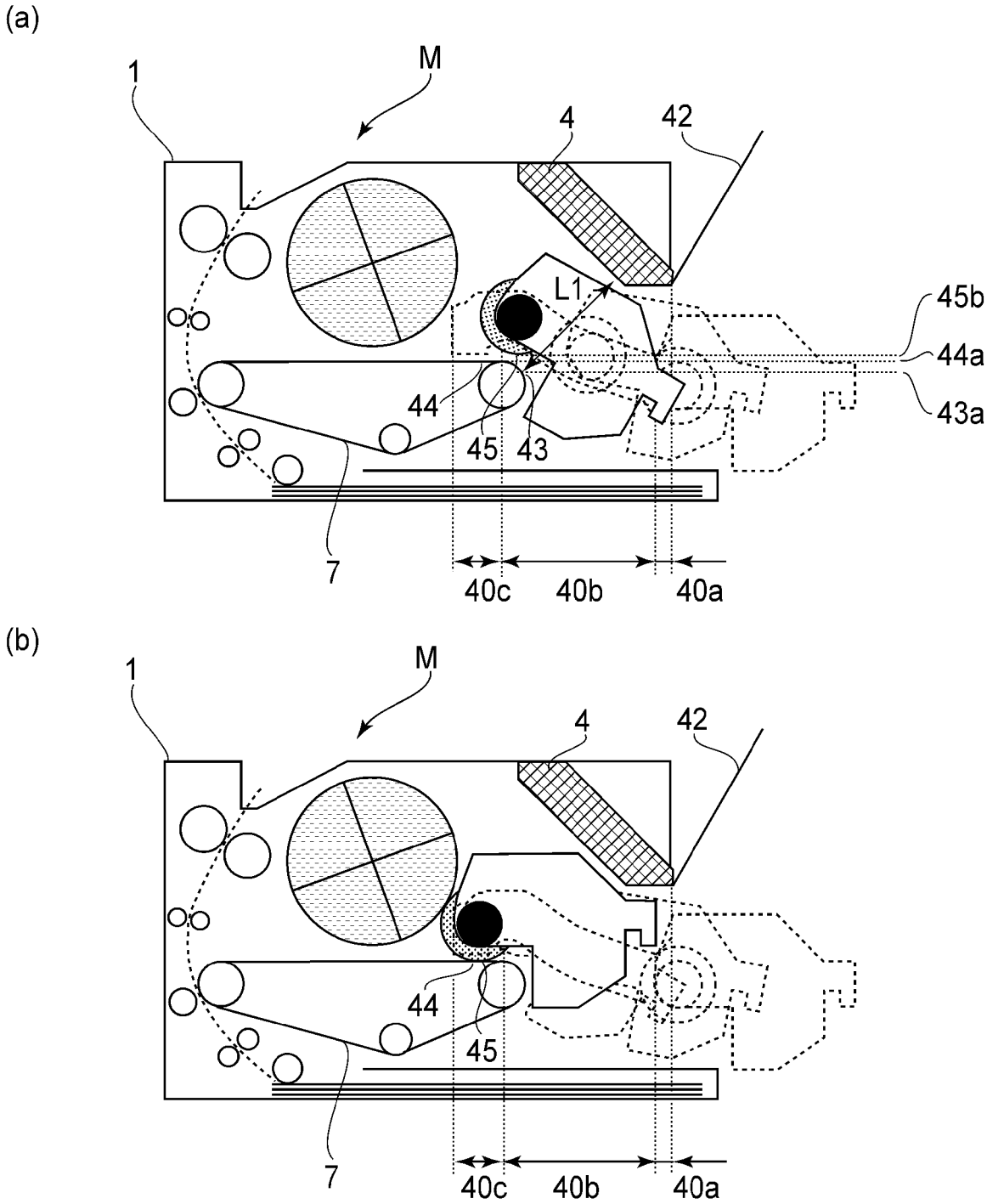
FIGS. 6(*a*) and 6(*b*) are schematic sectional views of the image forming apparatus in the first embodiment, and show how a drum cartridge is mounted into, or dismounted from, the main assembly of the apparatus.

Next, referring to FIGS. 5 and 6, the procedure for mounting the drum cartridge A into the main assembly 1 of the image forming apparatus M, and the procedure for dismounting the drum cartridge A from the main assembly 1, are described. In order to make it easier to describe the state of engagement between the cartridge guiding groove 40 of the apparatus main assembly 1 and the support projection 34 of the drum cartridge A, the state of engagement is described with reference to FIGS. 5 and 6, whereas the drum cartridge A itself will be described with reference to its side view. Incidentally, the "vertical direction" in the following description of the above-mentioned procedures is the direction perpendicular to the surface on which the image forming apparatus M is placed for image formation as shown in FIGS. 5 and 6.

As the front cover 42 of the main assembly 1 of the image forming apparatus M is opened upward, the opening 46 through which the drum cartridge A is mounted into, or dismounted from, the apparatus main assembly 1, and also, through which the drum cartridge passage is visible on the inward side of the opening 46. The opening 46 is for allowing the drum cartridge A, which is one of the process cartridges of the image forming apparatus M, to be inserted into the interior of the main assembly of the image forming apparatus A. Although the small size of the image forming apparatus M was realized by position the exposing means 4 at an angle relative to the main assembly 1 of the apparatus M, the opening 46 between the exposing means 4 and sheet feeder cassette 11 is large enough for at least the drum cartridge A to easily pass. The cartridge guiding groove 40 is a part of the side wall of the apparatus main assembly 1, and is shaped so that the support projection 34 of the drum cartridge A snugly fits in the groove 40. That is, the cartridge guiding groove 40 (which hereafter will be referred to simply as guiding groove 40) is a guiding member in which the support projection 34 is engaged to guide the drum cartridge A. The guiding groove 40 has three distinctive sections, that is, the first, second, and third sections listing from the upstream side in terms of the direction in which the drum cartridge A is mounted into the apparatus main assembly 1 (drum cartridge mounting direction). The first section is an opening section 40*a*, and the second section is a mid section 40*b*. The third section is an end section 40*c*. When the drum cartridge A is mounted into the apparatus main assembly 1, the opening section 40*a* guides the support projection 34 (i.e., drum cartridge A) from the point at which the bottommost point of the image bearing member 2 is below the transfer point, that is, the point of contact between the image bearing member 2 and intermediary transfer belt 7, in terms of the vertical direction, through the opening 46. The mid section 40*b* is on the downstream side of the opening section 40*a* in terms of the direction in which the drum cartridge A is mounted into the apparatus main assembly 1. It guides the support projection 34 from the point before which the bottommost point of the peripheral surface of the image bearing member 2 is below the transfer point in terms of the vertical direction, to the point beyond which the bottommost point of the peripheral surface of the image bearing member 2 is above the transfer point. The end section 40*c* is on the downstream side of the mid section 40*b* in terms of the cartridge mounting direction. It guides the support projection 34 (i.e., drum cartridge A) from the point before which the bottommost point of the peripheral surface of the image bearing member 2 is above the transfer point in terms of the vertical direction, to the point beyond which the bottommost point of the peripheral surface of the image bearing member 2 is below the transfer point. The end section 40*c* is on the downstream side of the mid section 40*b* in terms of the drum cartridge mounting direction. The end section 40*c* guides the support projection 34 (i.e., drum cartridge A) from the point before which the bottommost point of the peripheral surface of the image bearing member 2 is above the transfer point in terms of the vertical direction, to the transfer point.

Referring to FIGS. 5 and 6, a line L1 corresponds to the narrowest point of the drum cartridge passage (distance between exposing means 4 and intermediary transfer belt 7), and a referential number 43 stands for the bottom of the line L1. A referential number 44 stands for the point (area) of contact between the image bearing member 2 and intermediary transfer belt 7 during an image forming operation, and a referential number 45 stands for the bottommost point of the peripheral surface of the image bearing member 2 when the drum cartridge A is in its horizontal position.

FIG. 5(*b*) depicts the state of the drum cartridge A, in which the support projection 34, the axial line of which coincides with the axial line of the image bearing member 2 of the drum cartridge A, is at the outward end of the opening section 40*a* (entrance) of the guiding groove 40. The drum cartridge A is inserted into the apparatus main assembly 1, more specifically, the space between the exposing means 4 and sheet feeder cassette 11, in the direction indicated by an arrow mark g. Since the image forming apparatus M is smaller than image forming apparatuses, the exposing means 4 of which is not angled, it is more limited in terms of the positioning of the drum cartridge passage. Thus, the apparatus main assembly 1 is structured so that in order to engage the support projection 34 into the guiding groove 40, the drum cartridge A has to be positioned in such a manner that the bottommost point 45 (position 45*a* in vertical direction) of the image bearing member 2 is below the bottom end 43 (position 43*a* in vertical direction) of the line L1 (which corresponds narrowest point of drum cartridge passage).

FIG. 6(*a*) depicts the state of the drum cartridge A, in which the support projection 34 of the drum cartridge A is in the mid section 40*b* of the guiding groove 40, which is on the downstream side of the opening section 40*a* in terms of the drum cartridge mounting direction. While the support projection 34 is in the mid section 40*b* of the guiding groove 40, the support projection 34 (i.e., drum cartridge A) is guided so that the bottommost point of the image bearing member 2 of the drum cartridge A rises to the position (position 45*b* in vertical direction) which is above the bottom end 43 (position 43*a* in vertical direction) of the line L1 (which corresponds to narrowest point of drum cartridge passage), and also, above the transfer point 44 (position 44*a* in vertical direction) of the intermediary transfer belt 7.

FIG. 6(*b*) depicts the state of the drum cartridge A, in which the support projection 34 of the drum cartridge A is in the end section 40*c* which is on the downstream side of where the support projection 34 is in the position shown in FIG. 6(*a*), in terms of the drum cartridge mounting direction, and in which the drum cartridge A is precisely positioned for image formation. That is, as the support projection 34 of the drum cartridge A is guided through the mid section 40*b* as shown in FIG. 6(*a*), the bottommost point 45 of the image bearing member 2 is raised above the bottom end of the line L1 (which corresponds to narrowest point of drum cartridge passage) and the transfer point 44 of the intermediary transfer belt 7. Thereafter, as the support projection 34 is moved into the end of the end section 40*c*, the bottommost point 45 of the image bearing member 2 comes into contact with the intermediary transfer belt 7 from the direction which coincides with the directional component of the vector which shows the direction and amount of the pressure (force) which the image bearing member 2 applies to the intermediary transfer belt 7 as it comes into contact with the intermediary transfer belt 7, as shown in FIG. 6(*b*). That is, the directional component of the vector which shows the direction and amount of the force which the bottommost point 45 of the image bearing member 2 applies to the intermediary transfer belt 7 as it comes into contact with the intermediary transfer belt 7 coincides with the moving direction of the intermediary transfer belt 7. Therefore, there is virtually no friction between the image bearing member 2 and intermediary transfer belt 7 at the moment when the image bearing member 2 comes into contact with the intermediary transfer belt 7. Thus, it does not occur that the peripheral surface of the image bearing member 2 and the outward surface of the belt 7 are frictionally scarred when the drum cartridge A is moved into the image formation position. Therefore, it does not occur that the image forming apparatus M outputs substandard images because of the frictional scars attributable to the placement of the drum cartridge A into the image formation position.

In other words, even though the image forming apparatus M in this embodiment is significantly smaller than comparable image forming apparatuses in accordance with the prior arts, it can guide the drum cartridge A into the image formation position in such a manner that the image bearing member 2 smoothly comes into contact with the intermediary transfer belt 7.

As the drum cartridge A in this embodiment is mounted into the apparatus main assembly 1, it is positioned so that when the drum cartridge A is in its image formation portion and image formation attitude, the bottommost point 37 of the drum cartridge A is below the bottommost point 45 of the image bearing member 2 in terms of the vertical direction. Positioning the drum cartridge A as described above causes the transfer residual developer 31 to naturally fall into the waste developer chamber 30, making it easier to collect the waste developer into the waste developer chamber 30. In other words, it makes it unnecessary to place a residual developer conveying means 31 in the waste developer chamber 30. That is, the drum cartridge A in this embodiment is simpler in structure; the present invention can simplify a drum cartridge in structure.

Figure 7:
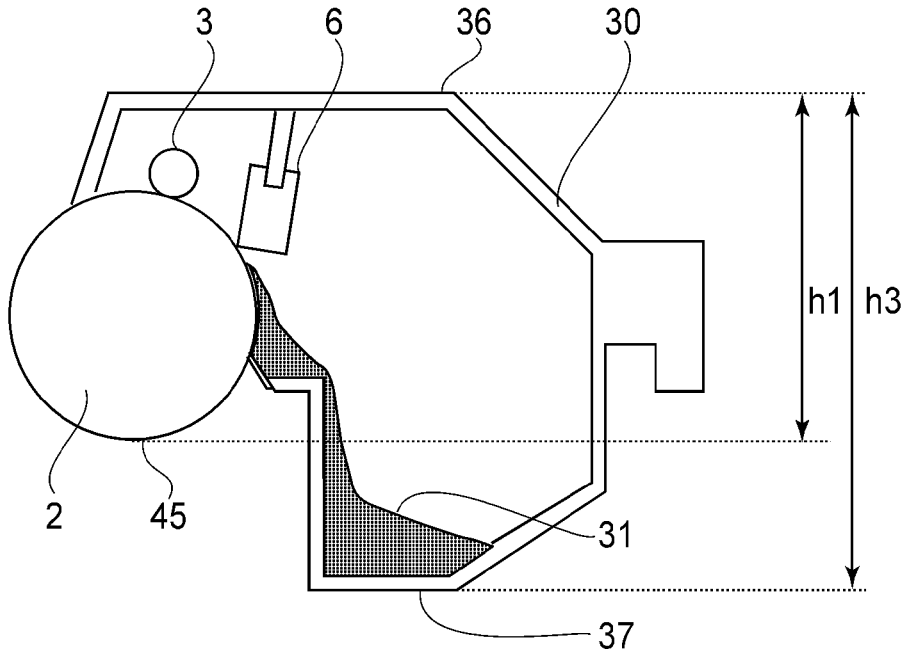
FIG. 7(*a*) is a schematic sectional view of an example of the drum cartridge in the first embodiment, and FIG. 7(*b*) is a schematic sectional view of the main assembly of the image forming apparatus and the drum cartridge in the first embodiment, and shows how the drum cartridge is mounted into, or dismounted from the main assembly.
Figure 7:
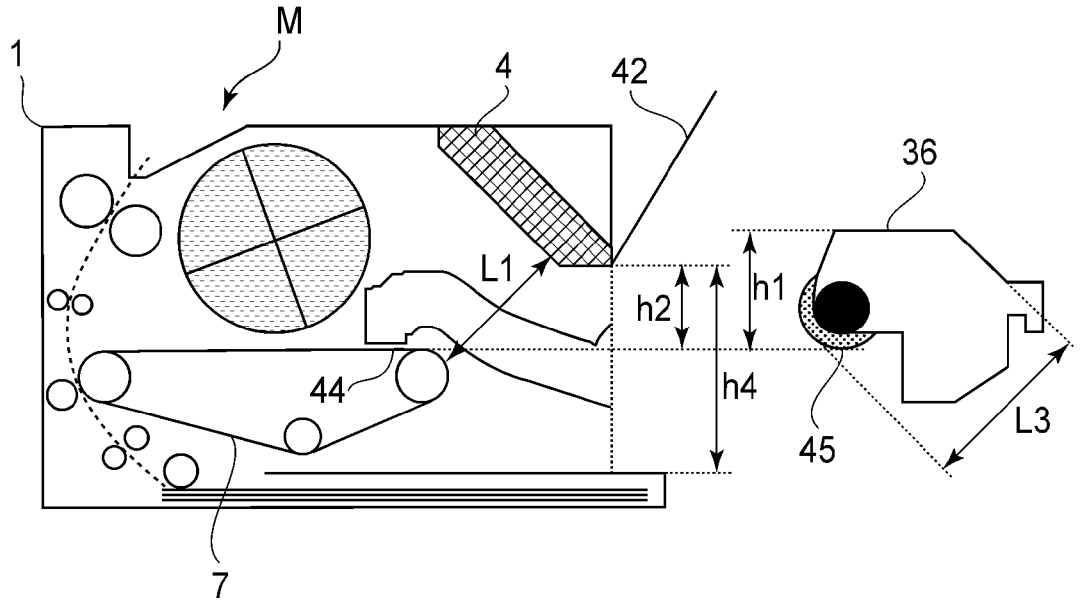

On the other hand, the small size of the image forming apparatus M was realized by tilting the exposing means 4. Therefore, the apparatus M is more restricted than comparable image forming apparatuses in accordance with the prior arts, in terms of the mounting and dismounting of the drum cartridge A. More specifically, referring to FIG. 7(*b*), not only does the tilting of the exposing apparatus 4 reduce the opening 46 in height h4, but also, in the distance h2 between the transfer point 44 of the intermediary transfer belt 7 and the top edge of the opening 46. Yet, the drum cartridge A has to be tall enough for the cleaning blade 6 and charge roller 3 to be placed in the cartridge A as shown in FIG. 7(*a*). Referring again to FIGS. 7(*a*) and 7(*b*), a referential code h1 stands for the height (distance) between the bottommost point 45 of the peripheral surface of the image bearing member 2 and the top surface 36 of the drum cartridge A when the drum cartridge A is in the image formation attitude, and a referential code h3 stands for the height (distance) between the top and bottom surfaces 36 and 37, respectively, of the drum cartridge A. In the case of the combination of the image forming apparatus M and drum cartridge A in this embodiment, the relationship among those heights (distances) h1, h2, h3, and h4 is: h3<h4, h2<h1. That is, in terms of the vertical direction, the height h3 of the drum cartridge A is less than the height h4 of the opening of the apparatus main assembly 1. The height (distance) h2 between the top edge of the opening 46 and the transfer point 44 is less than the distance h1 between the top surface 36 of the drum cartridge A, and the bottommost point of the image bearing member 2. Also referring to FIG. 7(*b*), a line L3, which is parallel to the line L1 (which corresponds to narrowest point of drum cartridge passage), stands for the dimension of the widest portion of the drum cartridge A, which has to pass through the narrowest portion of the drum cartridge passage, which is L1 in dimension. The relationship between L1 and L3 is: L1<L3. That is, one of the characteristic features of the image forming apparatus M in this embodiment is that the distance L1, which is the dimension of the narrowest point of the drum cartridge passage, that is, the space between the intermediary transfer belt 7 and exposing means 4 of the apparatus main assembly 1, and the distance L3, which is the dimension of the largest (widest) point of the drum cartridge A in terms of the direction parallel to the distance L1 when the drum cartridge A is moved through the drum cartridge passage, is: L1<L3. Even though the image forming apparatus M and drum cartridge A are structured as described above, the height h1 of the drum cartridge A is less than the distance L1 of the narrowest point of the drum cartridge passage of the image forming apparatus M. Therefore, the drum cartridge A can be mounted into, or dismounted from, the apparatus main assembly 1 by causing the drum cartridge A to rotate as shown in FIG. 8B so that it is only the portion of the drum cartridge A, which is least in height (h1), that is put through the narrowest portion of the drum cartridge passage of the apparatus main assembly 1.

Figure 8A:
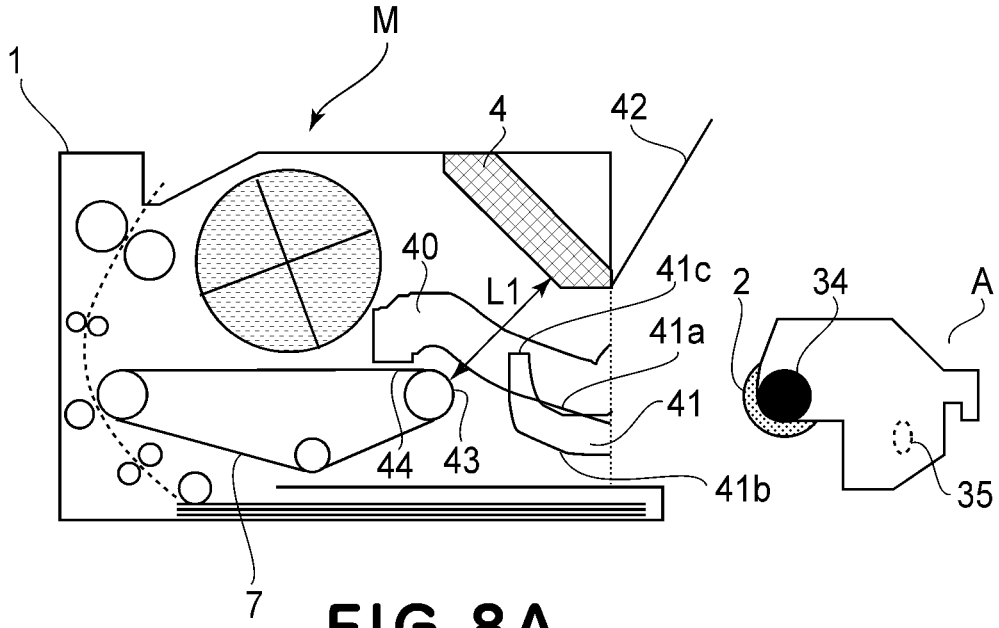
FIGS. 8A, 8B, and 8C are schematic sectional views of the main assembly of the image forming apparatus and the drum cartridge in the first embodiment, and show how the drum cartridge is mounted into, or dismounted from the main assembly.
Figure 8B:
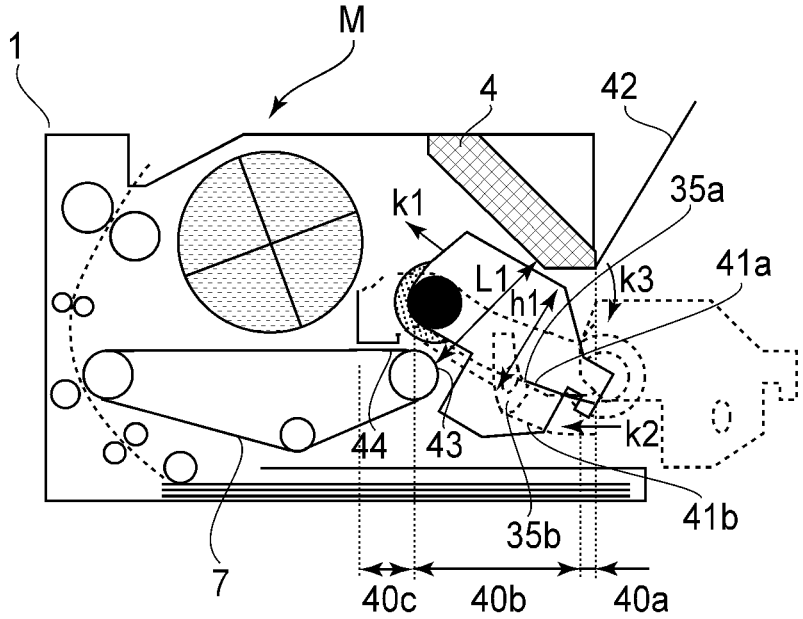
Figure 8C:
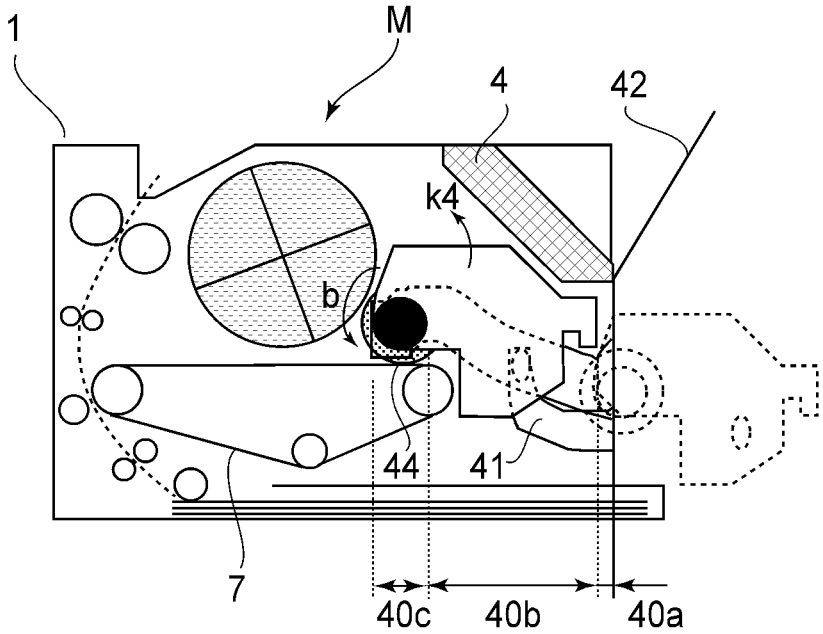
Figure 9:
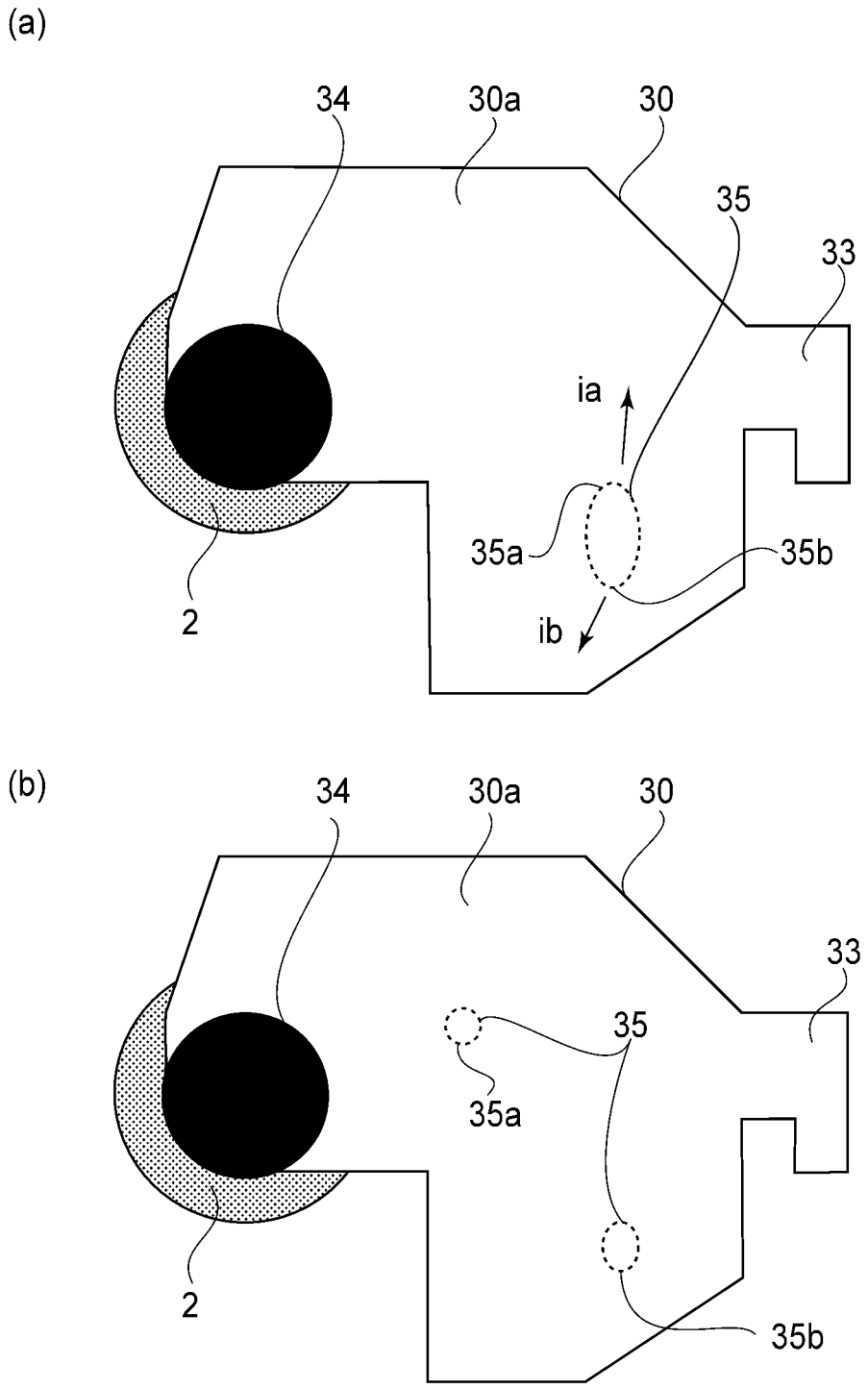
FIGS. 9(*a*) and 9(*b*) are schematic cross-sectional views of an example of the drum cartridge in the first embodiment.
Figure 10:
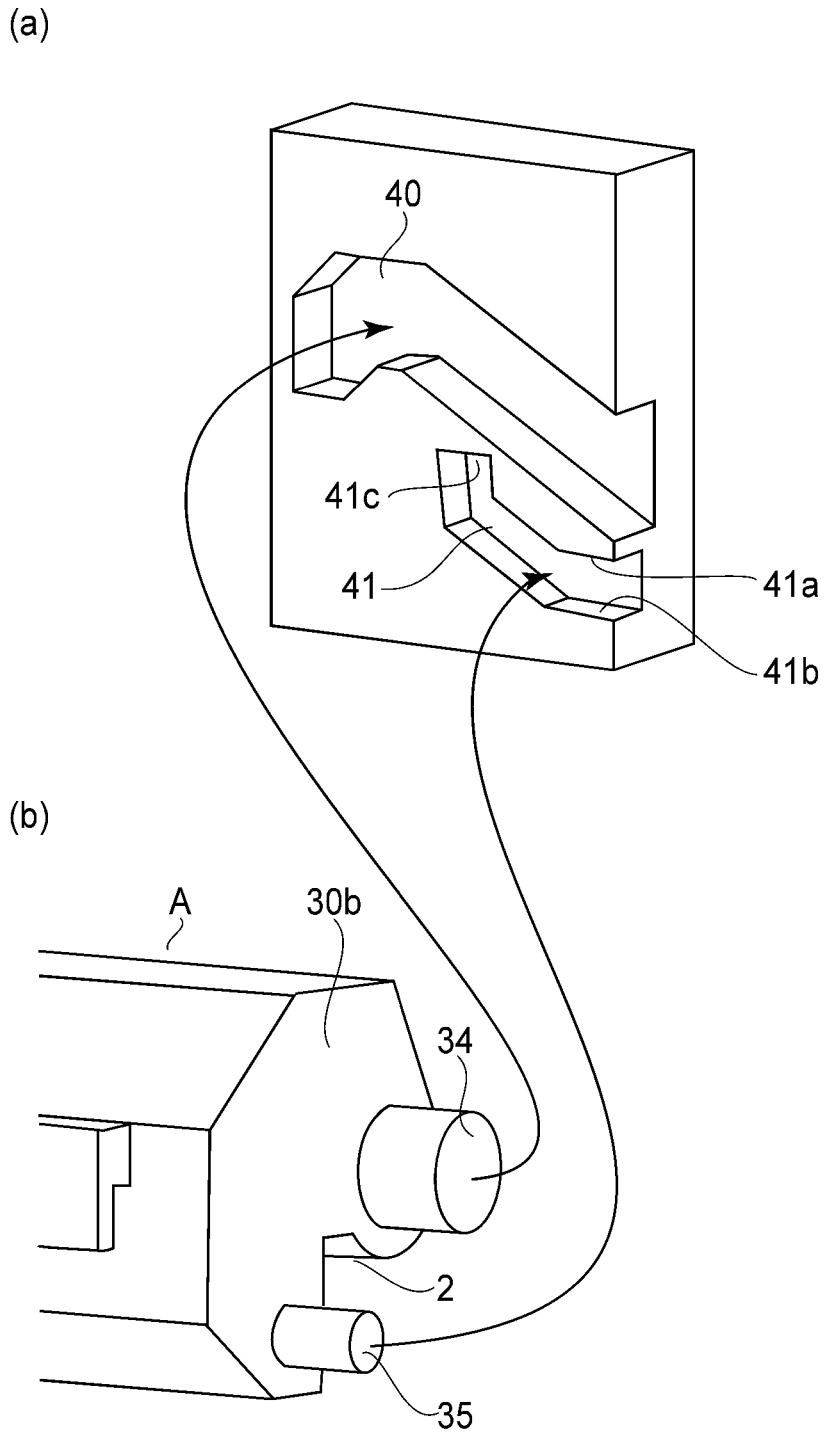
FIG. 10(*a*) is a schematic perspective view of an example of a cartridge guiding groove in the first embodiment, and FIG. 10(*b*) is a schematic perspective view of one of the lengthwise end portions of the drum cartridge in the first embodiment.

Next, referring to FIGS. 8 to 10, the structural arrangement for causing the drum cartridge A to change in attitude when mounting or dismounting the drum cartridge A is described. The structural arrangement on the main assembly side of the image forming apparatus M is described with reference to FIGS. 8A, 8B, and 8C, which are schematic sectional views of the image forming apparatus M, whereas, the structural arrangement for the drum cartridge A is described with reference to side views of the drum cartridge A. FIG. 10(*a*) is a schematic perspective view of the guiding groove 40 and second guiding groove 41 (in FIGS. 8A-8C) of the main assembly 1 of the image forming apparatus M. FIG. 10(*b*) is a perspective view of the support projection 34 and an attitude control projection 35 of the drum cartridge A (in FIGS. 8A-8C). Incidentally, the "vertical direction" in the following description of the aforementioned structural arrangements is the direction perpendicular to the surface on which the image forming apparatus M is placed for image formation, as shown in FIGS. 8-10.

The drum cartridge A has an attitude control portion 35 (projection), which perpendicularly projects from the lengthwise end surface 30*b* (FIG. 10(*b*) of the waste developer storage portion 30, which is the opposite lengthwise end surface of the waste developer storage portion 30, from the lengthwise end surface 30*a* of the waste developer storage portion 30 (which is on rear side in FIG. 8A). As the drum cartridge A is inserted into the image forming apparatus M, it is held by its support projections 34 (axial line of which coincides with axial line of image bearing member 2) and the guiding grooves 40 of the apparatus main assembly 1, whereas it is controlled in attitude by its attitude control portion 35 (projection), so that the drum cartridge A is precisely positioned relative to the apparatus main assembly 1, in the apparatus main assembly 1. More specifically, when the drum cartridge A is mounted into the apparatus main assembly 1 through the drum cartridge passage, it can be controlled in rotational movement by the guiding groove 41 which guides the attitude control portion 35. The image forming apparatus M shown in FIGS. 8A-8C is virtually the same in structure as the image forming apparatus M described with reference to FIG. 5(*a*), except for the number and structure of the guiding grooves. That is, the main assembly 1 of the apparatus M shown in FIGS. 8A-8C is provided with the second guiding groove 41, which is auxiliary to the guiding groove 40. The guiding groove 40 controls (guides) the support projection 34 of the drum cartridge A, whereas the second guiding groove 41 controls the drum cartridge A in attitude by guiding the attitude control portion 35 (projection) of the drum cartridge A. Thus, the drum cartridge A can be controlled in attitude while it is moved through the drum cartridge passage to be mounted into, or dismounted from, the apparatus main assembly 1.

While the support projection 34, the axial line of which coincides with that of the image bearing member 2 of the drum cartridge A, is in the opening section 40*a* of the guiding groove 40, a user has to keep holding the drum cartridge A by grasping the handhold 33 of the cartridge A, even though the support projection 34 is in the guiding groove 40. Then, the drum cartridge A is to be inserted farther into the apparatus main assembly 1. As the drum cartridge A is inserted farther, the support projection 34 is moved from the opening section 40*a* into the mid section 40*b*, which is on the downstream side of the opening section 40*a* in terms of the drum cartridge mounting direction. While the support projection 34 is moved from the opening section 40*a* of the drum cartridge guiding groove 40 into the mid section 40*b* which leads to the end section 40*c*, the main portion of the drum cartridge A is moved diagonally upward (indicated by arrow mark k1) as shown in FIG. 8B. During this movement of the drum cartridge A, the attitude control portion 35 (projection) of the drum cartridge A is horizontally guided (as indicated by arrow mark k2) by the second guiding groove 41 as shown in FIG. 8B. Therefore, the drum cartridge A is rotated in the direction indicated by an arrow mark k3 in FIG. 8B. This rotation of the drum cartridge A, that is, the drum cartridge rotation which occurs while the support projection 34 is in the mid section 40*b* of the guiding groove 40 causes the portion of the drum cartridge A, which corresponds to the height h1, to move through the narrowest portion of the drum cartridge passage, which corresponds to the dimension L1, allowing thereby the drum cartridge A to be mounted into, or dismounted from, the apparatus main assembly 1, even though the dimension L3 of the cartridge A, which is shown in FIG. 7(*b*), is greater than the dimension L1 of the drum cartridge passage, which corresponds to the narrowest point of the drum cartridge passage. Next, the movement of the drum cartridge A, which occurs when the support projection 34 is moved from the mid section 40*b* shown in FIG. 8A, into the end section 40*c*, which is on the downstream side of the mid section 40*b* in terms of the drum cartridge mounting direction, that is, the movement of the drum cartridge A, which occurs when it is moved into the position for image formation, is described. As the support projection 34, the axial line of which coincides with that of the image bearing member 2, is moved into the end of the end section 40*c*, the drum cartridge A is precisely placed in its image formation position in the apparatus main assembly in terms of the horizontal direction, that is, the axial line of the image bearing member 2 is precisely positioned for image formation, relative to the apparatus main assembly 1. During an image forming operation, the image bearing member 2 is rotated in the direction indicated by the arrow mark b in FIG. 8C, and therefore, the drum cartridge A is subjected to such a force that works in the direction to rotate the drum cartridge A in the direction indicated by an arrow mark k4 in FIG. 8C. However, the attitude control portion 35 (projection) of the drum cartridge A has been placed in contact with the drum cartridge rotation control portion 41*c* of the second guiding groove 41, by the aforementioned final rotational movement of the drum cartridge A, and therefore, it does not occur that the drum cartridge A rotates during an image formation.

Next, the attitude control portion 35 (projection) which rotationally moves the drum cartridge A when the drum cartridge A is mounted into, or dismounted from, the apparatus main assembly 1 is described in detail. Referring to FIG. 9(*a*), the drum cartridge A is rotatable about the support projection 34, the axial line of which coincides with the axial line of the image bearing member 2. The rotational movement of the drum cartridge A about the support projection 34 in the direction indicated by an arrow mark is controlled by the portion 35*a* of the attitude control portion 35 (projection), whereas the rotational movement of the drum cartridge A about the support projection 34 in the direction indicated by an arrow mark ib is controlled by the portion 35*b* of the attitude controlling portion 35 (projection). That is, referring to FIG. 8B, while the support projection 35 is in the mid section 40*b*, the portions 35*a* and 35*b* of the attitude control portion 35 are guided by the wall portions 41*a* and 41*b*, respectively, of the second guiding groove 41, causing thereby the attitude control portion 35 (projection) to move in the direction indicated by an arrow mark k2. Incidentally, although the drum cartridge A shown in FIG. 9(*a*) is provided with only a single attitude control portion, that is, the attitude control portion 35, a drum cartridge may be provided with two attitude control portions 35*a* and 35*b* as shown in FIG. 9(*b*). In other words, all that is necessary is for a drum cartridge to be provided with a portion 35*a* for controlling the rotational movement of the drum cartridge about the support projection 35 in the direction indicated by the arrow mark ia, and a portion 35*b* for controlling the rotational movement of the drum cartridge about the support portion 35 in the direction indicated by the arrow mark ib. That is, the structural arrangement for the drum cartridge regarding the positioning of the portions for controlling the rotational movement of the drum cartridge about its support projection can be varied within the scope of the present invention.

Figure 11:
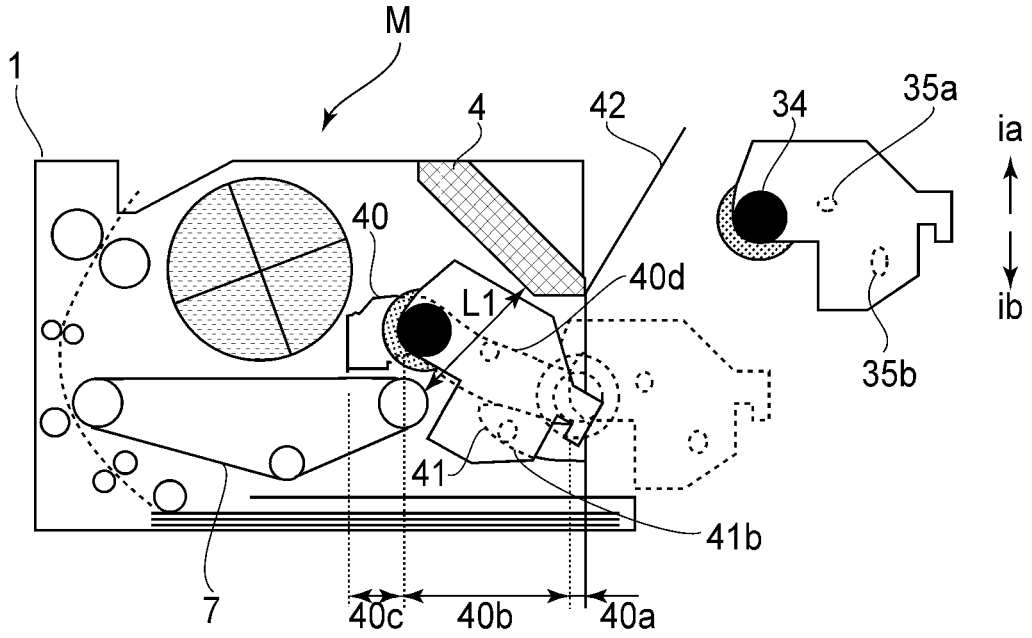
FIG. 11A is a schematic sectional view of the main assembly of the image forming apparatus and the drum cartridge in the first embodiment, and shows how the drum cartridge is mounted into, or dismounted from, the main assembly, and FIG. 11(*b*) is a schematic perspective view of an example of a drum guiding groove in the first embodiment.
Figure 11:
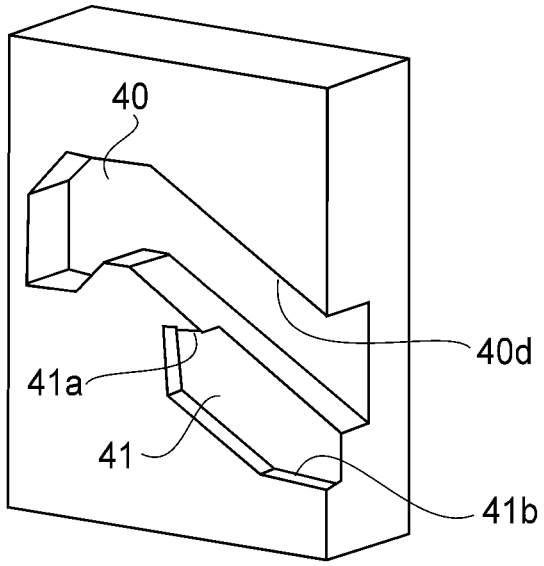

In the case of the drum cartridge A structured as described above, the guiding groove 40 and second guiding groove 41 are independent from each other. However, in some cases, it is difficult to provide the apparatus main assembly 1 with two drum cartridge guiding grooves (40 and 41) which are independent from each other, because various components other than the above described ones, for example, an image bearing member driving force inputting means, an intermediary transfer belt supporting members, charge volt contacts, etc., have to be attached to the lateral walls of the apparatus main assembly, and/or because the size reduction of the drum cartridge make it impossible to provide the apparatus main assembly 1 with the second guiding groove independent from the primary guiding groove, in addition to the primary guiding groove. In such cases, the apparatus main assembly 1 may be structured so that the rotational movement of the drum cartridge A in the direction indicated by the arrow mark is controlled by guiding the portion 35*a* of the attitude control portion 35 by the wall 40*d* of the guide groove 40 as is the support portion 34, and the rotational movement of the drum cartridge in the direction indicated by the arrow mark ib is controlled by guiding the portion 35*b* of the attitude control portion 35 by the wall 41*b* of the second guiding groove 41, as shown in FIGS. 11(*a*) and 11(*b*). The employment of the above described structural arrangement for the apparatus main assembly 1 can afford more latitude in the positioning of the guiding groove 40, support projection 34, second guiding groove 41, and attitude control portion 35.

In the case of the image forming apparatus M and the drum cartridge A therefor, the second guiding groove 41 is a part of the rear wall (with reference to sectional drawings) of the image forming apparatus M, and the attitude control portion 35 (projection) is a part of the rear wall (with reference to sectional drawings) of the drum cartridge A. However, the second guiding groove 41 and attitude control portion 35 (projection) may be provided on the front or both sides (front and rear sides) of the image forming apparatus M.

Figure 12:
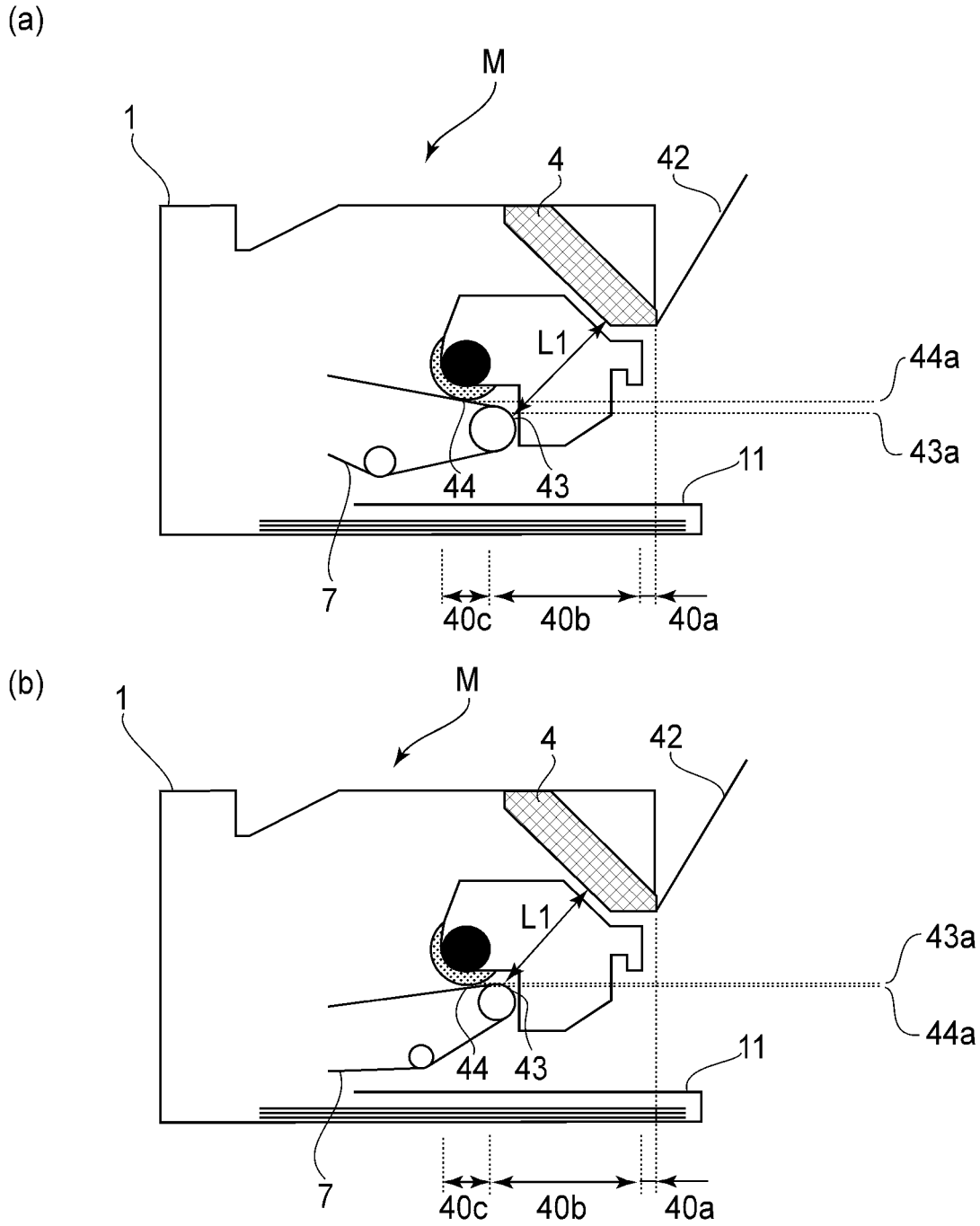
FIGS. 12(*a*) and 12(*b*) are schematic sectional views of the image forming apparatus in the first embodiment, and show how the drum cartridge is mounted into, or dismounted from, the main assembly of the image forming apparatus.

Further, in the case of the image forming apparatus M described above, the intermediary transfer belt 7 with which the image bearing member 2 comes into contact with is positioned so that the portion of the intermediary transfer belt 7, which is facing the image bearing member 2, becomes horizontal. However, the image forming apparatus M may be structured so that the portion of the intermediary transfer belt 7, which is facing the image bearing member 2, becomes tilted. That is, referring to FIGS. 12(*a*) and 12(*b*), the area of contact between the intermediary transfer belt 7 and image bearing member 2 may be tilted. In a case where the above-mentioned portion of the intermediary transfer belt 7 is tilted, the positional relationship between the point 43 of the intermediary transfer belt 7 (height 43*a*), which corresponds to the narrowest point of the drum cartridge passage, which has the dimension L1, and the transfer point 44 (height 44*a*) of the intermediary transfer belt 7 may reverse in terms of the vertical direction. Even in such a case, while the support portion 34 of the drum cartridge A is in the mid section 40*b* of the guiding groove 40, the bottommost point 45 of the image bearing member 2 is positioned above the point of the intermediary transfer belt 7, which corresponds to the bottom end of the line L1, and the transfer point 44 of the intermediary transfer belt 7. Therefore, the drum cartridge A is guided in such a manner that the image bearing member 2 smoothly comes into contact with the intermediary transfer belt 7 even though the image forming apparatus M is substantially smaller than image forming apparatuses in accordance with the prior arts.

Embodiment 2

Figure 13:
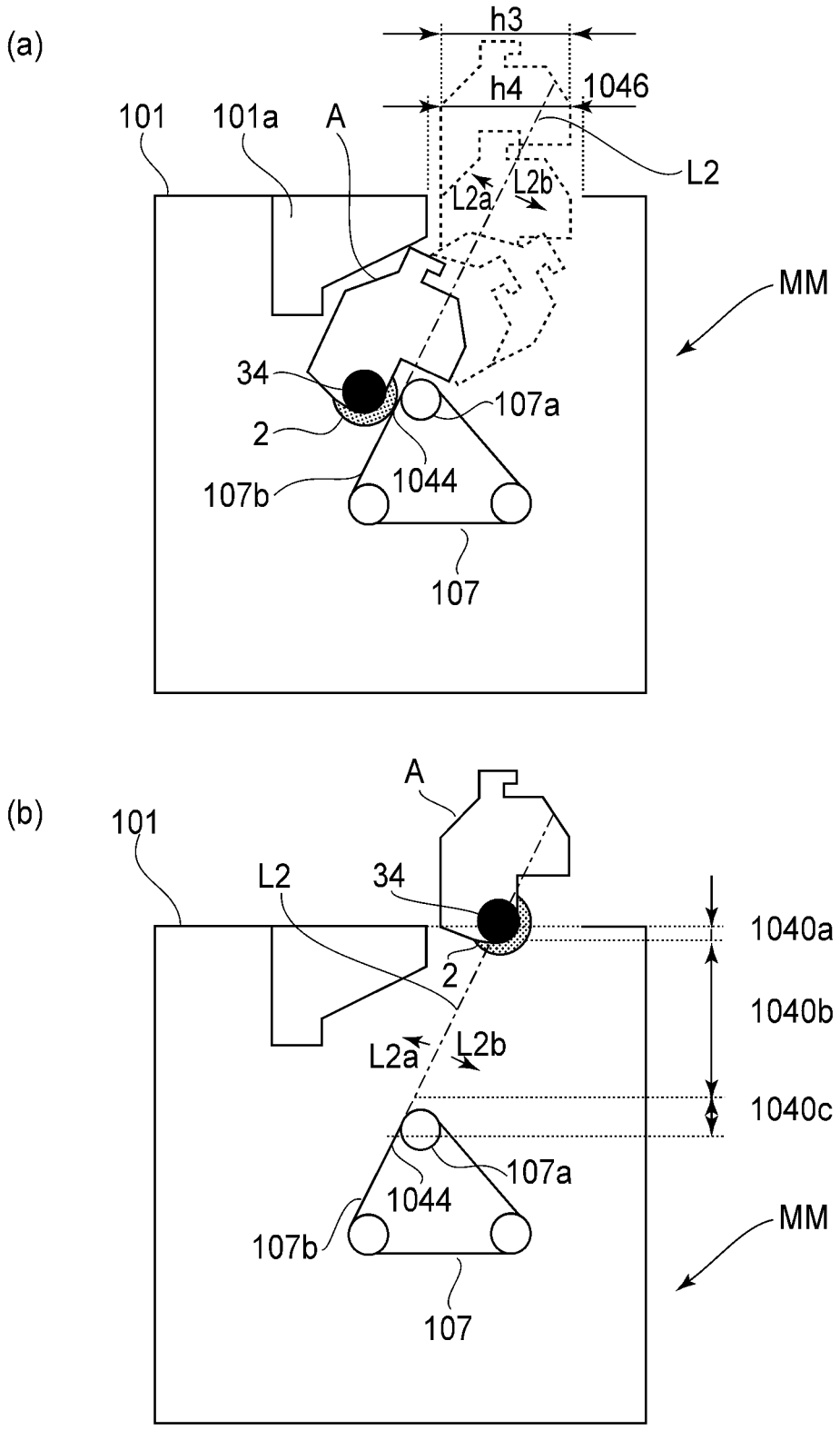
FIGS. 13(*a*) and 13(*b*) are schematic sectional views of the image forming apparatus in the second preferred embodiment of the present invention, and show how the drum cartridge is mounted into, or dismounted from, the main assembly of the apparatus.
Figure 14:
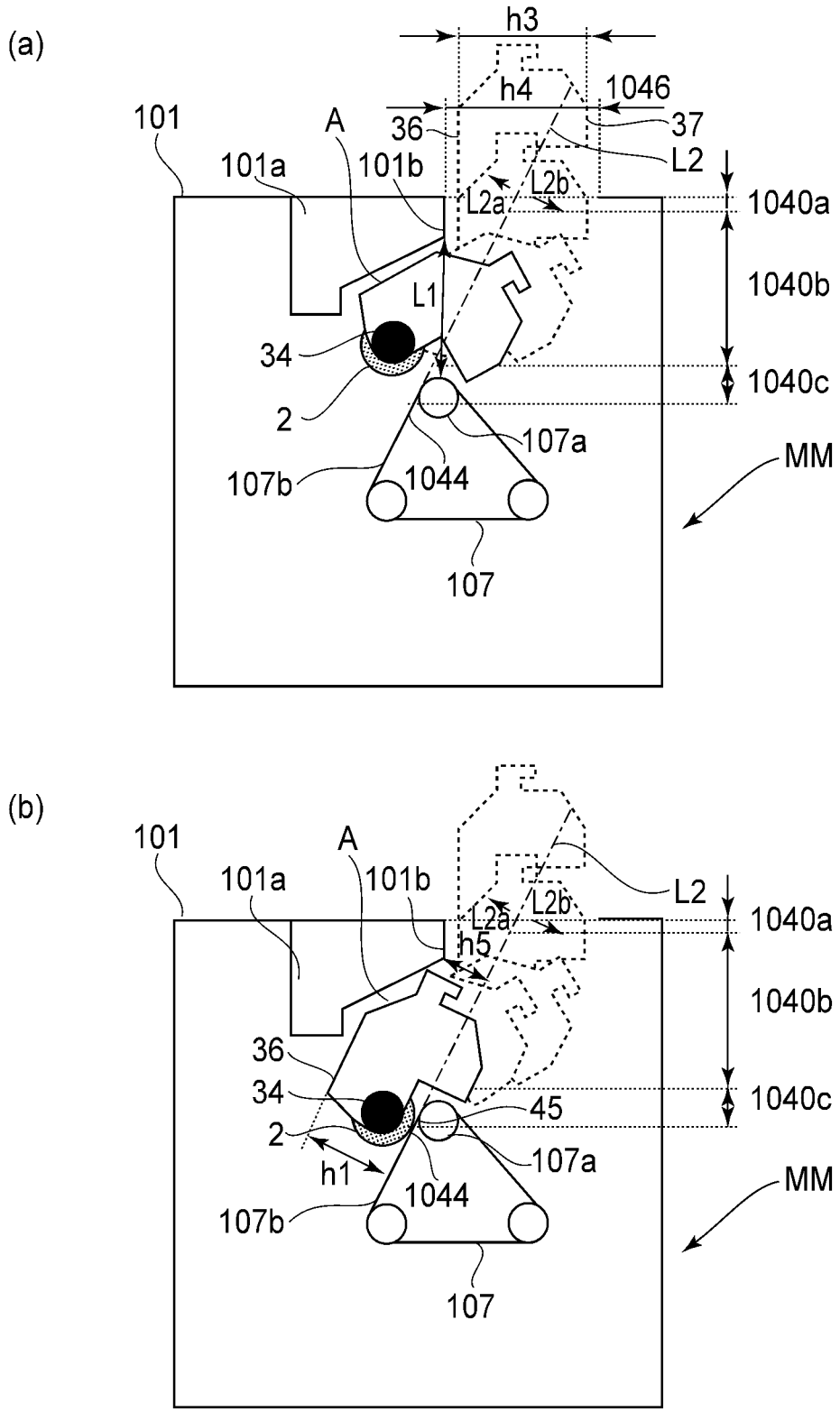
FIGS. 14(*a*) and 14(*b*) are schematic sectional views of the image forming apparatus in the second preferred embodiment of the present invention, and show how the drum cartridge is mounted into, or dismounted from the main assembly of the apparatus.

The image forming apparatus MM in the second preferred embodiment of the present invention is also a full-color laser beam printer based on four primary colors. FIGS. 13 and 14 are schematic sectional views of this image forming apparatus MM, and show the general structure of the apparatus MM. Since the image forming apparatus MM is roughly the same in structure as the image forming apparatus M described above, the apparatus MM will be described regarding only the portions of the apparatus MM, which are different from the counterparts of the apparatus M. Further, since the drum cartridge in this embodiment is the same in structure as the drum cartridge A described above, the components of the drum cartridge in this embodiment are given the same referential codes as those given to the counterparts of the drum cartridge A described above, respectively, and will not be described.

Referring to FIG. 13(*a*), the top wall of the main assembly 101 of the image forming apparatus MM has an opening 1046 through which the drum cartridge A is mounted into, or dismounted from, the apparatus main assembly 101. The opening 1046 is the opening through which the drum cartridge A is inserted (mounted) into the main assembly 101 of the image forming apparatus MM so that the image bearing member 2 comes into contact with the intermediary transfer belt 107, while preventing the drum cartridge A from coming into contact with the component 101*a* of the apparatus main assembly 101, and through which the drum cartridge A is dismounted from the apparatus main assembly 101*a* while being prevented from coming into contact with the component 101*a*.

Among the multiple rollers by which the intermediary transfer belt 107 is supported, the roller which is closest to the drum cartridge passage is referred to as belt support roller 107*a*. The area of contact between the image bearing member 2 and intermediary transfer belt 107 is referred to as transfer point 1044, and the surface of the intermediary transfer belt 107, which comes into contact with the image bearing member 2 at the transfer point 1044 is referred to as a transfer surface 107*b*. Next, referring to FIG. 13(*a*), the section of the transfer surface 107*b*, which includes the transfer point 1044, is referred as a transfer section L2. Further, the left side of the transfer section L2 is referred to as a transfer side L2*a*, where as the right side of the transfer section L2 is referred to as a non-transfer side L2*b*. In other words, the transfer side L2*a* corresponds to the outward side of the intermediary transfer belt 107 in terms of the loop which the intermediary transfer belt 107 forms, whereas the non-transfer surface adjacency L2*b* corresponds to the inward side of the intermediary transfer belt 107, that is, the opposite side of the intermediary transfer belt 107 from the transfer side L2*a*.

Like the image forming apparatus M, the image forming apparatus MM also has a pair of grooves 1040 in which the pair of support projections 34, with which the drum cartridge A is provided, are fitted to be guided by the grooves 1040, one for one, to guide the drum cartridge A. Each guiding groove has three distinctive sections, that is, the first, second, and third sections listing from the upstream side in terms of the direction in which the drum cartridge A is mounted into the apparatus main assembly 101. The first section is an opening section 1040*a*, and the second section is a mid section 1040*b*. The third section is an end section 1040*c*. When the drum cartridge A is mounted into the apparatus main assembly 101 through the opening 1046, the opening section 1040*a* guides the support projection 34 of the drum cartridge A from a point at which a least a part of the image bearing member 2 is on the above described non-transfer side L2*b* relative to the theoretical extension L of the outward surface of the intermediary transfer belt 7, which includes the transfer point. The mid section 1040*b* is on the downstream side of the opening section 1040*a* in terms of the direction in which the drum cartridge A is mounted into the apparatus main assembly 101. It guides the support projection 34 of the drum cartridge A from the point before which at least a part of the image bearing member 2 is on the non-transfer side L2*b* relative to the theoretical extension of the section L2 of the transfer surface 107*b*, to the point beyond which the entirety of the image bearing member 2 is on the transfer surface side L2*a* relative to the theoretical extension L2 and is away from the theoretical extension L2. The end section 1040*c* is on the downstream side of the mid section 1040*b* in terms of the cartridge mounting direction. It guides the support projection 34 of the drum cartridge A from the point before which the image bearing member 2 is on the transfer surface side L2*a* relative to the theoretical extension L2 and is away from the extension L2, to the point at which the image bearing member 2 is at the transfer point 1044. Next, this function of the guiding grooves 1040 is described in detail.

FIG. 13(*b*) is a drawing of the main assembly 101 of the image forming apparatus MM, and drum cartridge A when the support projection 34 of the drum cartridge A, the axial line of which coincides with the axial line of the image bearing member 2 of the drum cartridge A, is at the outward end of the opening section 1040*a*. Referring to FIG. 13(*b*), in order to create the image forming apparatus MM which is significantly smaller than comparable image forming apparatuses, the components 101*a* of the apparatus main assembly 101 were positioned as shown in FIG. 13(*b*). Thus, the opening 1046 through which the drum cartridge A is to be mounted into, or dismounted from, the apparatus main assembly 101 had to be positioned in a manner to border across the theoretical extension L2. Therefore, when the support projection 34, the axial line of which coincides with the axial line of the image bearing member 2 of the drum cartridge A is in the opening section 1040*a*, a part of the image bearing member 2 is in the non-transfer side L2*b*.

When the support projection 34 is in the mid section 1040*b* of the guiding groove 1040, the support projection 34 (i.e., drum cartridge A) is guided by the guiding groove 1040 in such a manner that the entirety of the image bearing member 2 of the drum cartridge A is moved into the transfer surface side L2*a*, and then, moved away from the theoretical extension L2, as shown in FIG. 14(*a*) which depicts the state of the image forming apparatus MM, in which the support projection 34 of the drum cartridge A, is in the mid section 1040*b*, which is on the downstream side of the opening section 1040*a* in terms of the drum cartridge mounting direction, after the insertion of the drum cartridge A into the apparatus main assembly 101.

FIG. 14(*b*) depicts the state of the image forming apparatus MM, in which the support projection 34 of the drum cartridge A is in the end section 1040*c*, which is on the downstream side of where the support projection 34 is in FIG. 14(*a*), in terms of the drum cartridge mounting direction, and in which the support projection 34 (i.e. drum cartridge A) is precisely positioned for image formation. That is, when the support projection 34 of the drum cartridge A is in the mid section 1040*b*, the drum cartridge A is positioned so that the entirety of the image bearing member 2 is positioned on the transfer surface side L2*a*, as shown in FIG. 14(*a*). Then, as the support projection 34 is moved into the end section 1040*c*, and moved through the end section 1040*c*, the image bearing member 2 is placed in contact with the intermediary transfer belt 107 from the direction which coincides with the directional component of the vector of the force which the image bearing member 2 applies as it comes into contact with the intermediary transfer belt 107. Therefore, the image bearing member 2 comes into contact with the intermediary transfer belt 107 with no friction between the two. Therefore, the problem that the image forming apparatus MM outputs substandard images because of the frictional scars formed on the peripheral surface of the image bearing member 2 and/or intermediary transfer belt 107 when the drum cartridge A is precisely positioned for image formation does not occur.

Also in this embodiment, the drum cartridge A is mounted in the apparatus main assembly 101 in such a manner that when the drum cartridge A is in the image forming position, the bottom portion of the drum cartridge A is below the bottommost point of the image bearing member 2, as in the first embodiment described above. Thus, as the transfer residual developer is removed from the image bearing member 2 by the cleaning blade, it naturally falls into the waste developer storage chamber, making it easier to collect the transfer residual developer into the waste developer storage chamber. In other words, it is unnecessary to provide the waste developer storage chamber with an internal means for conveying the transfer residual developer, making it possible to simplify the drum cartridge A in structure.

Further, the smaller size of the image forming apparatus MM was realized by placing the aforementioned component 101*a* as described above. Thus, there are some restrictions regarding the mounting and dismounting of the drum cartridge A. That is, referring to FIGS. 13 and 14, not only is the image forming apparatus MM less in the height h4 of the opening 1046, but also, in the height h5 (distance) between the transfer point 44 of the intermediary transfer belt 107 and the top edge 101*b* (which is top edge of component 101*a*), than comparable image forming apparatuses in accordance with the prior arts. Yet, the drum cartridge A has to be tall enough for the cleaning blade 6 and charge roller 3 to be placed in the cartridge A. Referring again to FIG. 14(*b*), a referential code h1 stands for the height (distance) between the bottommost point 45 of the peripheral surface of the image bearing member 2 and the top surface 36 of the drum cartridge A when the drum cartridge A is in the horizontal position, and a referential code h3 stands for the distance (height) between the top and bottom surfaces 36 and 37, respectively of the drum cartridge A. In the case of the combination of the image forming apparatus MM and drum cartridge A in this embodiment, the relationship among those distances (heights) h1, h2, h3, and h4 is: h3<h4, h5<h1. That is, in terms of the vertical direction, the height h3 of the drum cartridge A is less than the height h4 of the opening of the apparatus main assembly 101. In terms of the direction perpendicular to the aforementioned theoretical extension L2, the distance h5 between the bottom edge of the opening 1046 and the theoretical extension L2 is less than the distance h1 between the bottommost point 45 of the image bearing member 2 and the top surface 36 of the drum cartridge A. Incidentally, referring to FIG. 14 (*a*), also in this embodiment, the relationship between the dimension L1 of the narrowest point of the drum cartridge passage, and the dimension L3 (FIG. 7) of the widest point of the drum cartridge passage is: L1<L3. One of the characteristic features of the image forming apparatus MM and drum cartridge A in this embodiment is that the relationship between the smallest dimension L1 of the space between the intermediary transfer belt 107 and the opposite side of the portion of the apparatus main assembly 101 from the intermediary transfer belt 107, and the dimension L3 of the widest point of the drum cartridge A is: L1<L3. Even though the image forming apparatus MM and drum cartridge A are structured as described above, the height h1 of the drum cartridge A is less than the dimension L1 of the narrowest point of the drum cartridge passage of the image forming apparatus MM. Therefore, the drum cartridge A can be mounted into, or dismounted from, the apparatus main assembly 101 by rotationally moving the drum cartridge A so that the portion of the drum cartridge A, which is least in height (h1) dimension, is put through the narrowest portion (dimension L1) of the drum cartridge passage of the apparatus main assembly 101.

Since the main assembly 101*a* of the image forming apparatus MM, which includes the guide grooves 1040, and the drum cartridge A, in this embodiment are structured as described above, the drum cartridge A can be mounted into, or dismounted from, the image forming apparatus MM, without causing the image forming apparatus MM to output substandard images, even through the apparatus MM is restricted in terms of the placement of its opening 1046 through which the drum cartridge A is mounted into, or dismounted from its main assembly 101. In other words, when the drum cartridge A is mounted into the apparatus main assembly 101, it can be guided in such a manner that the image bearing member 2 smoothly comes into contact with the intermediary transfer belt 107 even though the image forming apparatus MM is substantially smaller than comparable image forming apparatuses in accordance with the prior art.

[Miscellanies]

In the embodiments described above, the process cartridge removably mountable in the main assembly of the image forming apparatus comprised: the cartridge frame (shell); and the image bearing means, charging means (which is means for processing image bearing means), and cleaning means, which were integrally fitted in the cartridge frame (shell). However, these embodiments are not intended to limit the present invention in scope. That is, the present invention is also compatible to a process cartridge which has an image bearing member, and only one of the charging means and cleaning means.

Also in the preceding embodiments, the image forming apparatus was a printer. However, the preceding embodiments are not intended to limit the present invention in scope. That is, the present invention is applicable to image forming apparatuses other than a printer. For example, it is applicable to a copying machine, a facsimile machine, and a multifunction image forming apparatus, which is capable of performing two or more functions of the preceding image forming apparatuses, for example. Further, the present invention is applicable to an image forming apparatus which employs a belt as its recording medium conveying member, and transfers in layers monochromatic toner images, different in color, onto a sheet of recording medium on the recording medium conveying member. The application of the present invention to these image forming apparatuses can provide effects similar to those described above.

According to the present invention, it is possible to provide an image forming apparatus which is substantially smaller than comparable image forming apparatuses in accordance with the prior arts, and yet, can guide a process cartridge in such a manner that the image bearing member of the process cartridge smoothly comes into contact with the intermediary transfer belt of the main assembly of the apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 249751/2009 filed Oct. 30, 2009 which is hereby incorporated by reference.

What is claimed is:

1. An image forming apparatus to which a cartridge including an image bearing member and a frame supporting said image bearing member is detachably mountable, said image forming apparatus comprising:

a belt member for transferring a developed image formed on said image bearing member onto a recording material;

an opening provided to permit said cartridge to enter an inside of a main assembly of said image forming apparatus;

a first guide portion for guiding said cartridge through said opening from a position where a bottom end portion of said image bearing member is below, with respect to a vertical direction, a transfer position where said image bearing member and said belt member contact each other when said cartridge is mounted;

a second guide portion provided downstream of said first guide portion with respect to a mounting direction in which said cartridge is mounted to said main assembly, said second guide portion guiding said cartridge from a position where said bottom end portion is below, with respect to the vertical direction, the transfer position to a position where said bottom end portion is above the transfer position; and a third guide portion provided downstream of said second guide portion with respect to the mounting direction, said third guide portion guiding said cartridge from the position where said bottom end portion is above, with respect to the vertical direction, the transfer position to the transfer position.

2. The image forming apparatus according to claim 1, wherein a distance h2 between an upper end of said opening and the transfer position in the vertical direction and a distance h1 between said bottom end portion and a top end portion of said frame in the vertical direction when said cartridge is mounted to said main assembly, satisfy, $$h2<h1.$$

3. The image forming apparatus according to claim 1, wherein a shortest distance L1 of a gap between said belt member and said main assembly through which said cartridge passes, and a maximum dimension L3 of an outer configuration of said cartridge measured in a direction parallel with a direction of the shortest distance when said cartridge is mounted to said main assembly, satisfy $$L1<L3.$$

4. The image forming apparatus according to claim 1, wherein the developed image formed on said image bearing member is transferred onto said belt member.

5. The image forming apparatus according to claim 1, wherein said belt member feeds the recording material.

* * * * *